US005296900A

United States Patent [19]

Saijo et al.

[11] Patent Number: 5,296,900

[45] Date of Patent: Mar. 22, 1994

[54] SUBSTANTIALLY CYLINDRICAL DEVELOPER SUPPLYING CONTAINER FOR SUPPLYING APPROXIMATELY CONSTANT AMOUNTS OF DEVELOPER

[75] Inventors: Hiromitsu Saijo; Shunji Yamamoto; Akio Kimura, all of Osaka, Japan

[73] Assignee: Minolta Camera Kabushiki Kaisha, Osaka, Japan

[21] Appl. No.: 777,721

[22] Filed: Oct. 11, 1991

Related U.S. Application Data

[63] Continuation of Ser. No. 530,962, May 30, 1990, abandoned.

[30] Foreign Application Priority Data

May 31, 1989 [JP] Japan ..... 1-138531
May 31, 1989 [JP] Japan ..... 1-138532
May 31, 1989 [JP] Japan ..... 1-138533

[51] Int. Cl.[5] ..... G03G 15/06

[52] U.S. Cl. ..... 355/260; 118/653; 222/DIG. 1

[58] Field of Search ..... 355/245, 260; 222/167-169, 172, DIG. 1; 118/653

[56] References Cited

U.S. PATENT DOCUMENTS

| | | | |
|---|---|---|---|
| 3,160,395 | 12/1964 | Reising | 366/233 |
| 4,212,264 | 7/1980 | Knechtel et al. | 118/653 |
| 4,603,714 | 8/1986 | Marotta | 141/383 |
| 4,611,730 | 9/1986 | Ikesue et al. | 355/260 X |
| 4,615,364 | 10/1986 | Kawata | 222/DIG. 1 |
| 4,625,895 | 12/1986 | Tsukano | 355/260 X |
| 4,629,309 | 12/1986 | Tsukano et al. | 222/DIG. 1 X |
| 4,641,945 | 2/1987 | Ikesue et al. | 222/DIG. 1 X |
| 4,688,926 | 8/1987 | Manno | 222/DIG. 1 X |
| 4,696,418 | 9/1987 | Kurotaka et al. | 222/DIG. 1 X |
| 4,744,493 | 5/1988 | Ikesue et al. | 355/260 X |
| 4,937,628 | 6/1990 | Cipolla et al. | 222/DIG. 1 X |

FOREIGN PATENT DOCUMENTS

| | | | |
|---|---|---|---|
| 53-146639 | 12/1978 | Japan . | |
| 59-188678 | 10/1984 | Japan . | |
| 0220372 | 11/1985 | Japan | 355/260 |
| 0006285 | 1/1987 | Japan | 355/260 |
| 63-75769 | 4/1988 | Japan . | |
| 1559252 | 4/1977 | United Kingdom . | |
| 9001180 | 2/1990 | World Int. Prop. O. | 355/260 |

*Primary Examiner*—A. T. Grimley
*Assistant Examiner*—William J. Royer
*Attorney, Agent, or Firm*—Burns, Doane, Swecker & Mathis

[57] ABSTRACT

A developer supplying device includes: a substantially cylindrical developer container having on its peripheral surface a spiral groove, and being rotatable to transport a developer therein by the groove; a supplying element in a form of an opening provided at the peripheral surface of the container to supply the developer therethrough; and a regulating device provided in the container, regulating an amount of the developer supplied from the supplying element, and being so formed to reduce a sectional area between the regulating device and an inner surface of the container in the vicinity of the supplying element. The supplying device can have a container-supporting device having a guide device for guiding the developer supplied by the supplying element; and a supplying element-covering device provided at the peripheral surface of the container, and being opened to uncover the supplying element when the latter confronts the guide device for supplying the developer. The supplying device also can have a ball-like stirring device included in and movable within the container in accordance with rotation thereof to stir the developer. The supplying device further can have a holding device capable of being inserted thereinto the container and having the guide device; a transporting device for transporting the developer supplied through the guide device for development; a drive device for rotating the container; and a connecting device provided at one side of the container for rotation of the container within the holding device by the drive device.

26 Claims, 21 Drawing Sheets

SUBSTANTIALLY CYLINDRICAL DEVELOPER SUPPLYING CONTAINER FOR SUPPLYING APPROXIMATELY CONSTANT AMOUNTS OF DEVELOPER

This application is a continuation of application Ser. No. 07/530,962, filed May 30, 1990, now abandoned.

BACKGROUND OF THE INVENTION

The present invention relates to a developer supplying device for supplying a developer to a developing device of an image forming apparatus such as a copying machine, a printer, a facsimile or the like in which a powder developer is used.

An image forming apparatus is provided with a developer container removable therefrom. The developer drops from the container to the storing section thereof. Thereafter, the developer is supplied to a developing device through a toner transporting means.

However, according to the known art, the image forming apparatus requires a space for mounting the developer supplying container in addition to the storing section. Therefore, the image forming apparatus is large-sized. Furthermore, after the developer is supplied from the developer supplying container to the storing section, the space for accommodating the developer supplying container is substantially unnecessary.

Another type of developer supplying container has been provided in order to reduce the space for mounting the developer supplying container. With such container, a spiral groove is formed on the inner peripheral surface of a cylindrical member having an opening on one end thereof. The cylindrical member is rotated so that a developer is transported toward one end of the container along the spiral groove. The developer is supplied to the developing device directly through the opening. This construction eliminates the need for the provision of a developer storing section. Thus, an image forming apparatus is small-sized.

However, according to the above-described developer supplying container, the amount of a developer supplied from the opening thereof to the developing device greatly varies depending on the amount of the developer accommodated therein. As apparent from the graph of FIG. 6 in which the horizontal axis shows the number of rotations (developer supply period) of the developer supplying container and the vertical axis shows the supply amount of the developer per rotation of the developer supplying container, the amount of the developer which drops from the opening thereof gradually increases with the increase of rotations thereof and decreases from the peak value of rotations thereof. That is, the amount supplied by the developer supplying container per rotation always changes. Therefore, it is very difficult to control the amount and density of the developer in the developing device.

U.S. Pat. No. 4,641,945 discloses a developer supplying device for supplying a developer by rotating a cylindrical member having a spiral groove formed on the inner peripheral surface thereof.

The developer supplying device comprises a developer supplying container, a holding section for holding the developer supplying container, a driving section for rotating the developer supplying container mounted on the holding section, and a transporting section for transporting a developer supplied from the developer supplying container to the developing section of an image forming apparatus.

The developer supplying container comprises the spiral groove extending axially along the inner peripheral surface of the cylindrical member, a gear formed along the peripheral surface thereof, and a developer supplying opening positioned in the front section thereof. The holding section of the developer supplying container comprises a developer receiving opening, a cap into which the front section of the developer supplying container can be inserted, and a supporting frame for supporting the rear section of the developer supplying container and urging the developer supplying container toward the cap. The driving section is positioned alongside the holding section and includes a driving gear which engages a peripheral gear of the developer supplying container mounted on the holding section. The transporting section communicates with the developer receiving opening of the holding section and has a developer transporting means.

In the developer supplying device, the developer supplying container is accommodated in the holding section with the front section thereof having the developer supplying opening inserted into the cap and the rear section thereof supported by the supporting frame. In this condition, the supporting frame urges the developer supplying container toward the cap. The peripheral gear engages the driving gear of the driving section.

The developer supplying container is rotated by the rotation of the driving gear. As a result, the developer accommodated therein is fed toward the forward section of the cylindrical member along the spiral groove. Thus, the developer is supplied from the developer supplying opening to the transporting section through the developer receiving opening. Thereafter, the developer which has been transported to the transporting section is transported to the developing section.

According to the above developer supplying device, gear provided along the peripheral surface of the developer supplying container engages the driving gear positioned alongside the holding section. That is, the developer supplying container is rotated by a tangential force applied to the peripheral surface of the developer container. However, the tangential force is not uniformly applied to the periphery of the developer supplying container.

Accordingly, the rotational axis of the developer supplying container mounted in the holding section is displaced, so that the developer supplying container is shaken in the holding section. As a result, the contact position and the frictional force between the cylindrical developer supplying container and the holding section vary, so that a load applied to the driving gear varies to a great extent. In addition, the opening of the developer supplying container does not align with the developer introducing opening of the holding section communicating with the opening of the developer supplying container. Consequently, the developer is spilt from the gap between the two openings, thus polluting the periphery of the developer supplying container. Further, the developer spilt from the gap penetrates into the gap between the developer supplying container and the holding section. As a result, the frictional force between the developer supplying container and the holding section becomes great, and a load applied to the driving gear increases.

Furthermore, the above-described developer supplying device has the following problem. It is troublesome to mount the developer supplying container in the holding section. That is, it is necessary to move the supporting frame backward to provide a sufficient space between the cap and the rear wall of the supporting frame.

Additionally, it is necessary for the holding section to provide two members, the cap and the supporting frame, and also provide a spring for urging the supporting frame toward the cap. Thus, the number of parts to be assembled increases and it is troublesome to assemble the parts.

SUMMARY OF THE INVENTION

Accordingly, an essential object of the present invention is to provide a developer supplying device comprising a cylindrical developer supplying container capable of supplying an approximately constant amount of a developer.

Another important object of the present invention is to provide a developer supplying device comprising a cylindrical developer supplying container capable of stably rotating, resulting in reducing a load applied to a driving system of the container.

A further object of the present invention is to provide a developer supplying device comprising a cylindrical developer supplying container capable of easily mounting on a developer transporting device.

In accomplishing these and other objects, according to one preferred embodiment of the present invention, there is provided a developer supplying device comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; and regulating means provided in the container and regulating an amount of the developer supplied from the supplying means, the regulating means being so formed to reduce a sectional area between the regulating means and an inner surface of the container in the vicinity of the supplying means.

A developer supplying device according to another preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; regulating means provided in the container and regulating an amount of the developer supplied from the supplying means, the regulating means being so formed to reduce a sectional area between the regulating means and an inner surface of the container in the vicinity of the supplying means; supporting means for supporting the container and having a guide means for guiding the developer supplied by the supplying means; and cover means provided at the peripheral surface of the container for covering the supplying means, the cover means being opened to uncover the supplying means when the latter confronts the guide means for supplying the developer.

A developer supplying device according to a still another preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; regulating means provided in the container and regulating an amount of the developer supplied from the supplying means, the regulating means being so formed to reduce a sectional area between the regulating means and an inner surface of the container in the vicinity of the supplying means; and stirring means in a form of a ball included in the container and movable within the container in accordance with rotation thereof to stir the developer accommodated therein.

According to the constructions of the developer supplying devices, the developer is transported to the supplying means of the container along the spiral groove with the rotation of the container and the regulating means regulates the amount of the developer being transported. Therefore, the amount of the developer transported to the vicinity of the supplying means of the cylindrical container is constant. That is, the amount of the developer supplied from the supplying means of the container to a developer transporting device is substantially constant per rotation of the container.

According to the developer supplying devices, the developer accommodated in the container is transported to the supplying means thereof along the spiral groove with the rotation of the container and the amount of the developer is regulated by the regulating means. Therefore, the amount of the developer positioned in the vicinity of the supplying means is constant. Thus, the amount of the developer supplied from the supplying means to the developer transporting device is almost constant per rotation of the container. That is, the amount of the developer supplied from the supplying means to the developer transporting device is proportional to the number of rotations of the developer container. Therefore, the supply amount of the developer can be appropriately regulated by controlling the number of rotations of the container. In addition, the supply amount of the developer can be varied by changing the size of the supplying means, the volume of the developer amount regulating space, that is, the sectional area, and the rotational speed of the container. Thus, the amount of the developer can be accurately controlled.

A developer supplying device according to a further preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; and drive means for rotating the container, wherein the container is rotatably supported at its both ends by a first shaft and a second shaft respectively, the drive means rotating the first shaft to rotate the container.

According to the construction of the developer supplying device, the cylindrical developer supplying container is supported through the first and second shafts provided in both ends thereof and the rotational force is transmitted from the drive means thereto. Accordingly, the developer supplying container stably rotates about the axis thereof, so that a load applied to the driving system of the developer supplying container can be reduced.

According to the developer supplying device, the container is rotated about the shafts arranged on each end thereof. Therefore, since the rotational axis of the container is not displaced, a load applied to the driving system of the container is stably. Further, since the supplying means of the container is not displaced, a developer dropping opening, or a developer dropping path is not displaced from a developer receiving opening of a developer transporting device. Therefore, the developer is not spilt from the developer dropping opening, thus not soiling the periphery of the developer supplying device.

A developer supplying device according to a still further preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; holding means capable of being inserted thereinto the container and having guide means for guiding the developer supplied through the supplying means from the container; transporting means for transporting the developer supplied through the guide means for development; drive means for rotating the container; and connecting means provided at one side of the container for rotation of the container within the holding means by the drive means.

A developer supplying device according to another preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; transporting means for transporting the developer supplied from the container for development; holding means for holding the container, the holding means having guide means for guiding the developer supplied through the supplying means from the container to the transporting means, the holding means being further pivotable to enable detachment of the container therefrom; drive means for rotating the container; and a first supporting means for rotatably supporting the container thereby and for transferring rotary force from the drive means to the container therethrough.

A developer supplying device according to a further preferred embodiment of the present invention, comprising: a developer container of substantially cylindrical form and having on its peripheral surface a spiral groove extending therearound in an axial direction thereof, the container being rotatable to transport a developer therein by the spiral groove; supplying means in a form of an opening provided at the peripheral surface of the container to supply the developer therethrough; drive means for rotating the container to supply the developer from the supplying means and including a drive shaft; and driven means provided at one end of the container for connection with the drive shaft which includes a bearing portion and a guide portion adjacent thereto, wherein the driven means on the container is so connected with the drive shaft through the guide portion and the bearing portion.

According to the developer supplying devices of the present invention, the container is supported by the holding means into which it is inserted from one end thereof having the supplying means. The force for rotating the developer supplying container supported by the holding means is transmitted thereto from the drive means through the connecting means. The developer accommodated in the container is transported, according to the rotation thereof, along the spiral groove to the transporting means through the supplying means and the guide means. Thereafter, the developer is transported to a developing device through the transporting means.

According to the developer supplying devices, the container can be inserted into the holding means from one end thereof. Therefore, the operation for mounting it in the holding means can be facilitated. In addition, since the construction of the holding means is simple, the number of parts used is small, hence the developer supplying devices can be easily assembled. Further, the holding means can prevent developers from spilling from the container.

BRIEF DESCRIPTION OF THE DRAWINGS

These and other objects and features of the present invention will become clear from the following description taken in conjunction with the preferred embodiments thereof with reference to the accompanying drawings, in which:

FIG. 31(*b*) is a sectional view taken along the line A—A of FIG. 31(*a*);

DETAILED DESCRIPTION OF THE EMBODIMENTS

Figure 1:
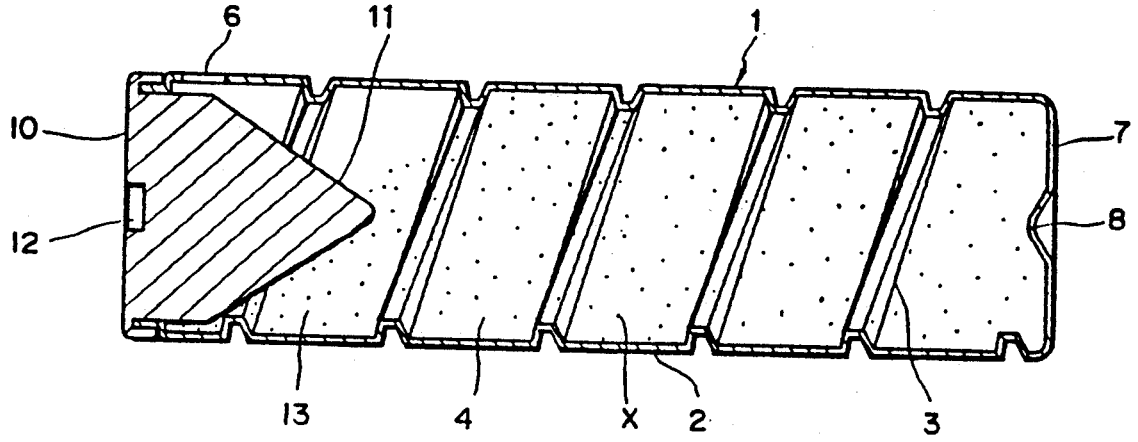
FIG. 1 is a longitudinal sectional view showing a developer supplying container according to a first embodiment of the present invention.

Before the description of the present invention proceeds, it is to be noted that like parts are designated by like reference numerals throughout the accompanying drawings.

Figure 2:
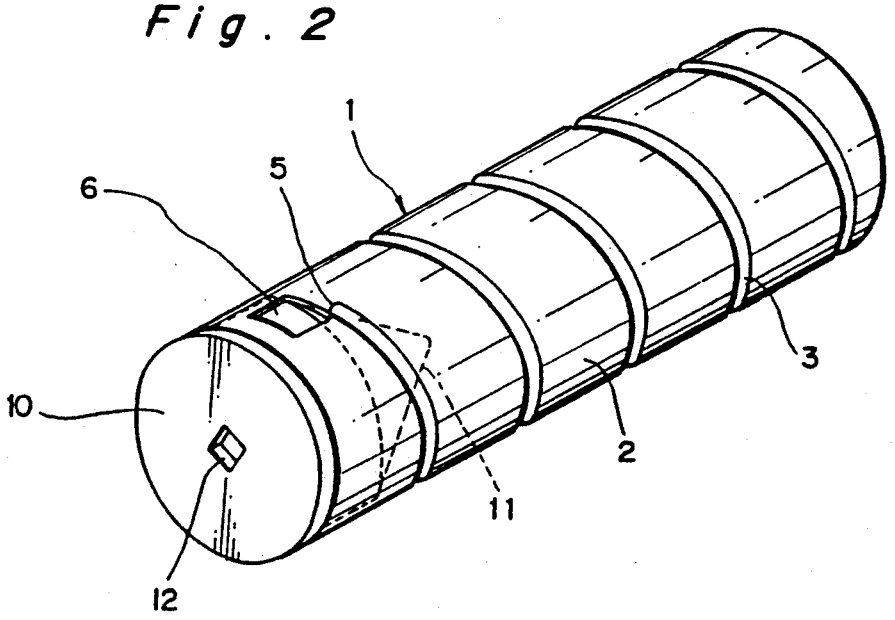
FIG. 2 is a perspective view showing the developer supplying container.

Referring now to the drawings, there is shown in FIGS. 1 and 2, a developer supplying container 1 of a developer supplying device according to the first embodiment of the present invention. The container 1 comprises a cylindrical member 2 in which one end is open to the outside and the other end is closed and a cover 10 removably mounted on one end, of cylindrical member 2, which is open. The other end of the cylindrical member 2 may be closed with a cover.

The cylindrical member 2 is integrally formed by blow-molding a thermoplastic resin. A projection 4 is spirally formed along the inner peripheral surface of the cylindrical member 2, so that a spiral groove 3 is formed between the projections 4 and 4 on the inner peripheral surface thereof. An opening 6 is formed in the vicinity of the termination 5 of the groove 3 and a concave portion 8 which recesses inwardly is formed in the center of the rear wall 7 (right side in FIG. 1) of the cylindrical member 2.

The cover 10 which projects inward, namely, toward the rear wall 7 is conical to form a conical regulating section 11 and the vertex of the conical regulating section 11 aligns with the axis of the cylindrical member 2. An engaging concavity 12 is formed at the center of the outer surface of the cover 10. The regulating section 11 may be semispherical or semielliptic.

A toner (X) is accommodated in the container 1 with the opening 6 of the cylindrical member 2 covered with a sealing tape not shown. Thereafter, the cylindrical member 2 is sealed with the cover 10. A starter consisting of a toner and a magnetic carrier may be used instead of the toner (X).

Figure 3:
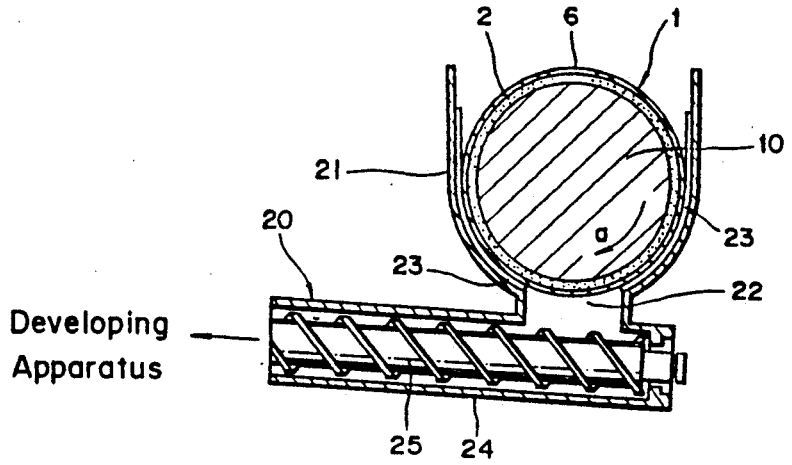
FIG. 3 is a cross sectional view showing the developer supplying container and a toner transporting device.
Figure 4:
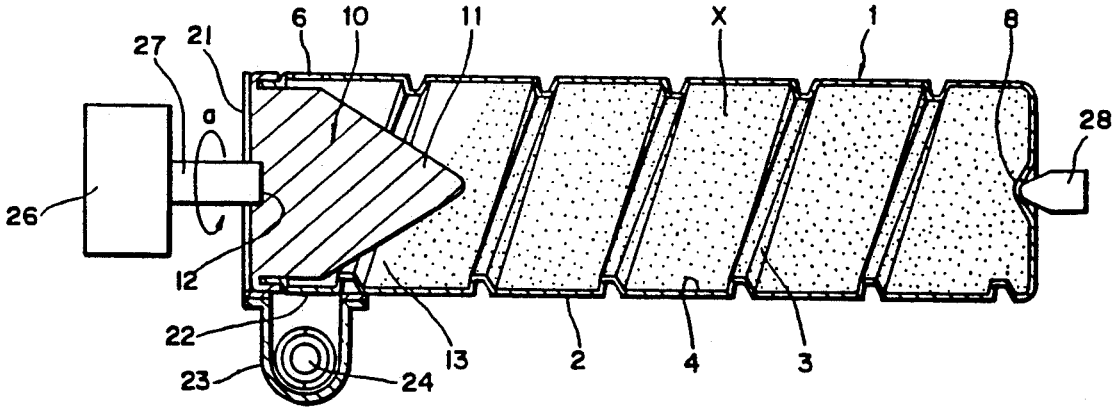
FIG. 4 is a longitudinal sectional view showing the developer supplying container and the toner transporting device.

Referring to FIGS. 3 and 4, a toner transporting device 20 on which the container 1 is mounted comprises an approximately U-shaped frame 21 and a toner transporting pipe 24 connected with a developing device. The frame 21 has a toner supplying opening 22 at the bottom thereof. The toner (X) drops from the container 1 to the toner transporting device 20 through the toner supplying opening 22 communicating with the toner transporting pipe 24. Sealing members 23 and 23 made of sponge or the like are mounted at both longitudinal side surfaces of the opening 22 which is the inner surface of the U-shaped frame 21. A toner transporting blade 25 accommodated in the toner transporting pipe 24 is rotated by a motor not shown. A driving device 26 is positioned alongside the frame 21. A driving shaft 27 of the driving device 26 penetrates into the frame 21. The rear wall 7 of the cylindrical member 2 is provided with a shaft 28 coaxial with the driving shaft 27 and movable along the axis thereof.

The container 1 is mounted on the toner transporting device 20 as follows. One end of the container 1 is supported by the frame 21 and the top of the driving shaft 27 is fitted into the concavity 12 of the cover 10. The top of the shaft 28 is fitted into and pressed against the concave portion 8 formed on the other end of the cylindrical member 2. Thus, the container 1 is approximately horizontally rotatable about the shafts 27 and 28. The container 1 is mounted on the toner transporting device 20 by positioning the opening 6 of the cylindrical member 2 upward. Before or after the container 1 is mounted on the toner transporting device 20, the sealing tape is removed so that the opening 6 is opened to the outside.

When the driving shaft 27 of the driving device 26 rotates in the direction shown by the arrow (a), the container 1 mounted on the toner transporting device 20 rotates in the direction shown by the arrow (a) of FIG. 4 about the driving shaft 27 and the shaft 28 opposed thereto.

As a whole, the toner (X) accommodated in the container 1 is transported toward one end of the cylindrical member 2 along the groove 4 with the rotation of the container 1 in the direction shown by the arrow (a). When the toner (X) arrives in a regulating space 13 positioned between the regulating section 11 of the cover 10 and the inner surface of the container 1, the movement of the toner (X) is regulated by the sectional area, of the regulating space 13, which is gradually reduced toward one end of the cylindrical member 2. Therefore, the amount of the toner (X) positioned in the vicinity of the opening 6 is constant.

The toner (X) which has reached the end of the cylindrical member 2 along the groove 4 drops to be supplied from the opening 6 to the toner transporting pipe 24 through the toner supplying opening 22 when the opening 6 is positioned downward with the rotation of the container 1. That is, the container 1 supplies the toner (X) to the toner transporting pipe 24 in a constant amount each time the container 1 rotates 360°. The toner (X) supplied to the toner transporting pipe 24 is transported to the developing device with the rotation of the transporting blade 25.

Figure 5:
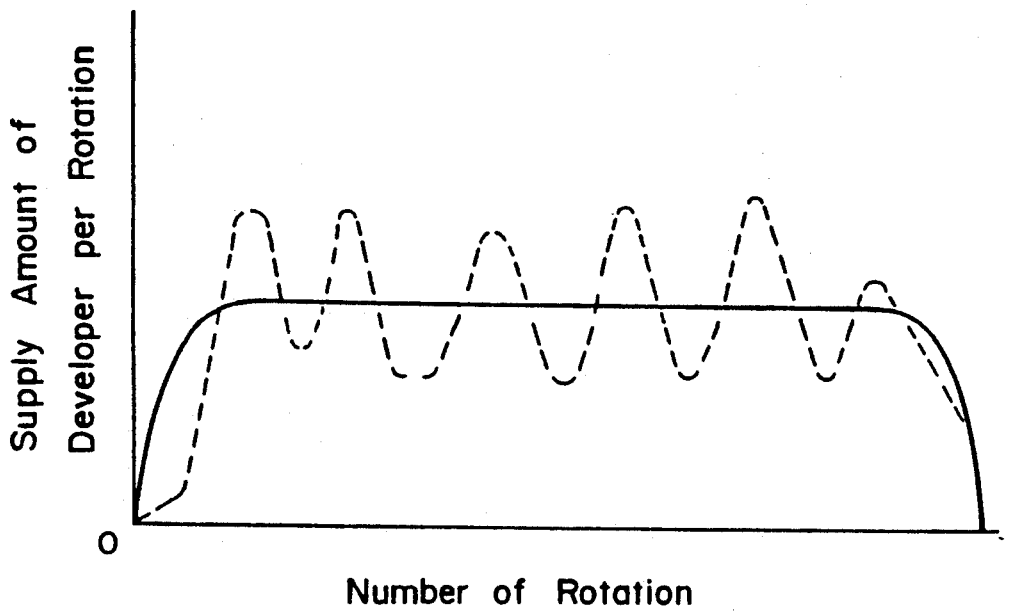
FIG. 5 is a graph showing the relationship between the number of rotations of the developer supplying container in accordance with the present invention and the amount of a developer supplied therefrom per rotation thereof.
Figure 6:
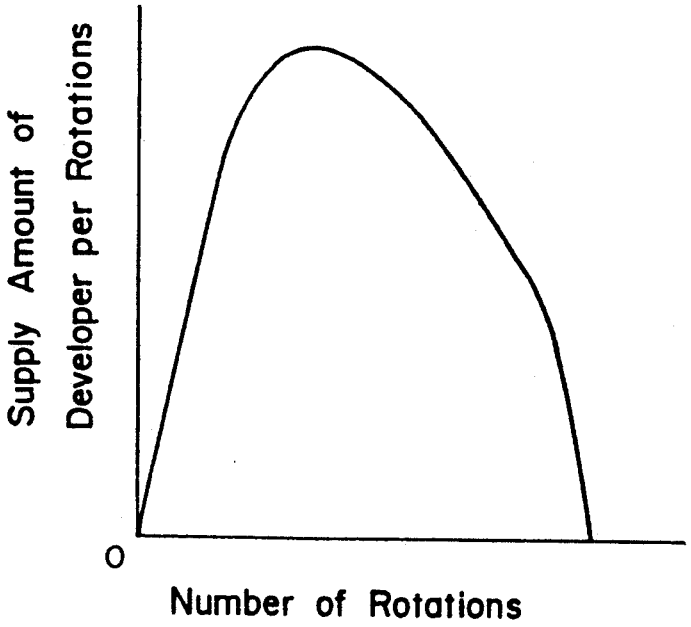
FIG. 6 is a graph showing the relationship between the number of rotations of a known developer supplying container and the amount of a developer supplied therefrom per rotation thereof.

The amount of the toner (X) supplied from the container 1 to the toner transporting pipe 24 is constant per rotation thereof as shown by the solid line of FIG. 5 except immediately when the container 1 is mounted on the toner transporting device 20 and when the toner (X) is not accommodated therein. In the graph, the vertical axis of the graph shows the toner amount supplied from the container 1 to the toner transporting pipe 24 per rotation of the container 1 and the horizontal axis thereof shows the number of rotations of the container 1. Since the opening 6 is positioned in the vicinity of the termination 5 of the groove 4, the toner (X) smoothly falls into the opening 6 to be supplied in a constant amount without scattering or being transported backward.

The curve shown by the dotted line of the graph shown in FIG. 5 indicates the result obtained by spacing the opening 6 from the termination 5 of the spiral groove 4. The curve indicates that the amount of the toner (X) which falls from the container 1 is unstable per rotation of the container 1. That is, when the toner (X) transported along the spiral groove 4 is moved beyond the end of the spiral groove 4, the movement of the toner (X) is not regulated. As a result, the toner (X) scatters and is moved backward.

A modification of the first embodiment of the present invention is described with reference to FIGS. 7, 8, and 9. In this modification, a cover 30 for covering the opening 6 is mounted on the cylindrical member 2. The cover 30 is rotatably supported by a shaft 31 which is positioned at the front edge of the opening 6 in the direction of the arrow (a) in FIG. 7.

Figure 7:
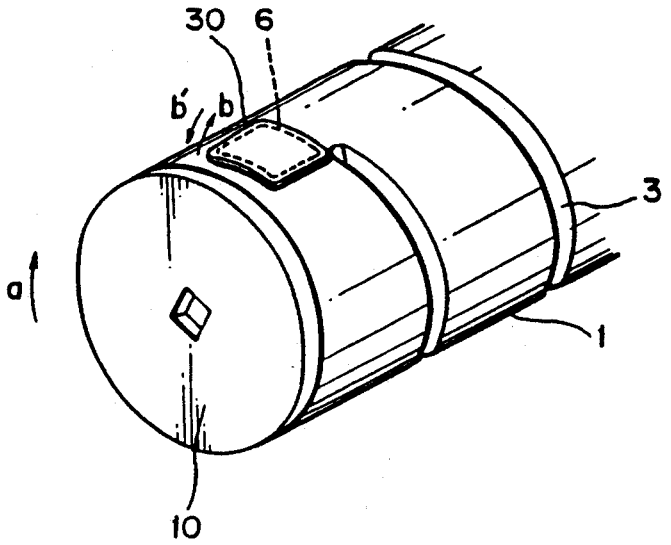
FIG. 7 is a partial perspective view showing a developer supplying container of a modification of the first embodiment of the present invention which has a cover for covering the opening thereof.

As shown in FIG. 7, when the opening 6 is positioned upward, the cover 30 closes the opening 6. While the opening 6 confronts the frame 21 with the rotation of the container 1, the frame 21 does not allow the cover 30 to open against its dead weight.

Figure 8:
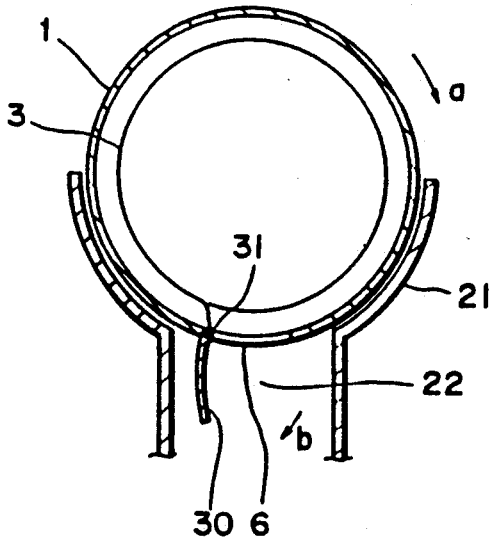
FIGS. 8 and 9 are cross sectional views showing the developer supplying container in FIG. 7.
Figure 9:
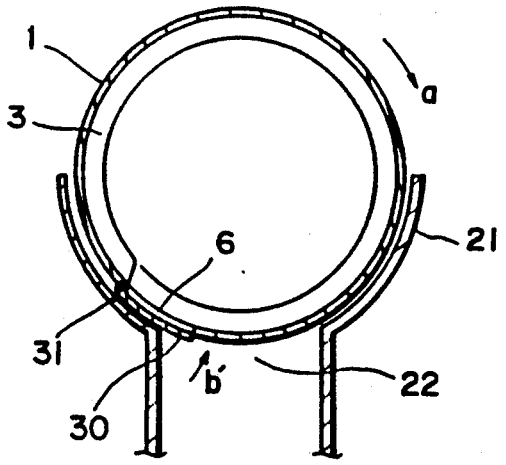

When the opening 6 confronts the toner supplying opening 22 communicating with the toner transporting pipe 24, the cover 30 is free from the regulation of the frame 21, and the cover 30 pivots about the shaft 31 in the direction shown by the arrow (b) in FIG. 8, so that the opening 6 is opened. As a result, the toner (X) drops to be supplied to the toner supplying opening 22. With the rotation of the container 1, the cover 30 is brought in contact with the wall frame 21 in the vicinity of the toner supplying opening 22, thus pivoting in the direction shown by the arrow (b') in FIG. 9. As a result, the cover 30 closes the opening 6. That is, the opening 6 is closed with the cover 30 except when the opening 6 confronts the toner supplying opening 22. Therefore, the amount of the toner (X) which is spilt between the container 1 and the frame 21 is small. Further, even though the toner (X) is agitated in the container 1 by the rotation of the container 1, it does not leak therefrom. That is, the toner (X) does not pollute the periphery of the container 1.

Figure 10:
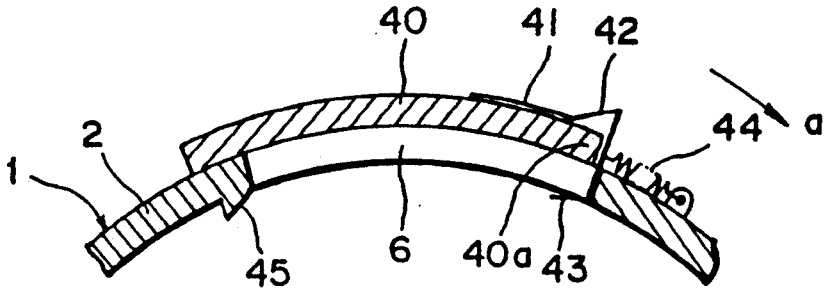
FIG. 10 is a partial cross sectional view showing a developer supplying container having a cover for covering the opening thereof according to another modification of the first embodiment of the present invention.
Figure 11:
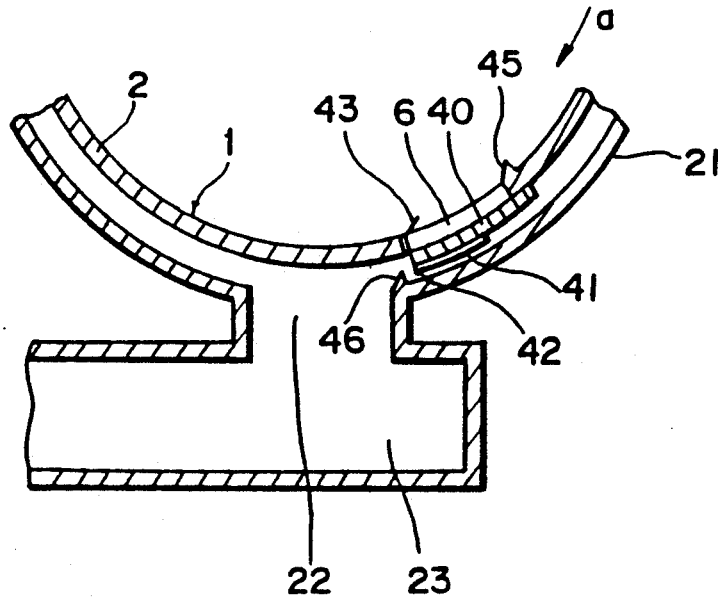
FIG. 11 is a partial cross sectional view showing the developer supplying container in FIG. 10 and the toner transporting device.

FIGS. 10 and 11 show a cover 40 for covering the opening 6 according to another modification of the first embodiment of the present invention. The cover 40 is slidable along the peripheral surface of the cylindrical member 2 and a leaf spring 41 with a predetermined width is fixed to the cover 40 at a forward portion thereof, that is, the right end portion of the cover 40. As best shown in FIG. 10, one end of the leaf spring 41 is fixed to the outer surface of the cover 40 and the other end portion thereof elongates toward the forward portion 40*a* of the cover 40. The other end portion of the spring 41 is bent outward in the vicinity of the forward portion 40*a* to form an engaging section 42 and then the other end portion is bent inward to pass through the opening 6 to project inward so as to form a projecting section 43 bent rearward. The leaf spring 41 is coupled to one end of a spring 44 and the other end thereof is fixed to the peripheral surface of the cylindrical member 2. Therefore, the spring 44 normally urges the leaf spring 41 and the cover 40 toward the direction shown by the arrow (a), namely, in the direction in which the opening 6 is closed.

As shown in FIG. 11, the cover 40 is circularly moved by the rotation of the container 1 with the opening 6 closed thereby. When the cover 40 confronts the toner supplying opening 22 of the frame 21, the engaging section 42 engages a projection 46 formed on the edge of the toner supplying opening 22, thus, the tension of the leaf spring 41 is not applied to the cover 40 and the cover 40 and the spring 41 is stopped from moving circularly. That is, with the rotation of the container 1, the cover 40 relatively moves with respect to the opening 6 in the direction opposite to the direction shown by the arrow (a) so as to open the opening 6. As a result, the toner (X) accommodated in the container 1 drops to be supplied to the toner transporting pipe 24. When the projection 43 mounts on a projection 45 formed on the rear end of the opening 6 with the rotation of the cylindrical member 2, the projection 43 and the engaging section 42 are moved toward the center of the cylindrical member 2. As a result, the engaging section 42 disengages from the projection 46. Consequently, the cover 40 is rotated in the direction shown by the arrow (a), thereby taking its initial position by the urging force of the spring 44. Thus, the opening 6 is closed.

Figure 12:
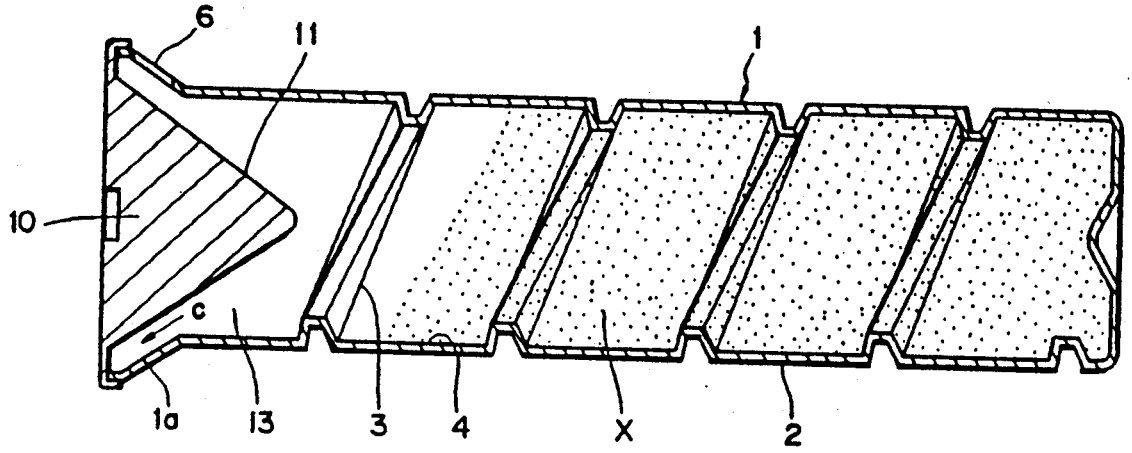
FIGS. 12 and 13 are longitudinal sectional views showing developer supplying containers according to other modifications of the first embodiment of the present invention.

According to a still another modification of the first embodiment of the present invention, the container 1 is substantially parallel with the regulating section 11 in the vicinity of one end thereof, i.e., the container 1 has a funnel-shaped section 1*a* as shown in FIG. 12. The opening 6 is formed on the funnel-shaped section 1*a*.

According to the container 1, when the toner (X) which has been transported into the regulating space 13 reaches the funnel-shaped section 1a, the toner (X) slides, by the gravity, along the funnel-shaped section 1a in the direction shown by the arrow (c) toward the opening 6. Thus, the toner (X) smoothly moves in the vicinity of the opening 6, so that the toner (X) drops to be supplied to the toner transporting device 20 without clogging.

Figure 13:
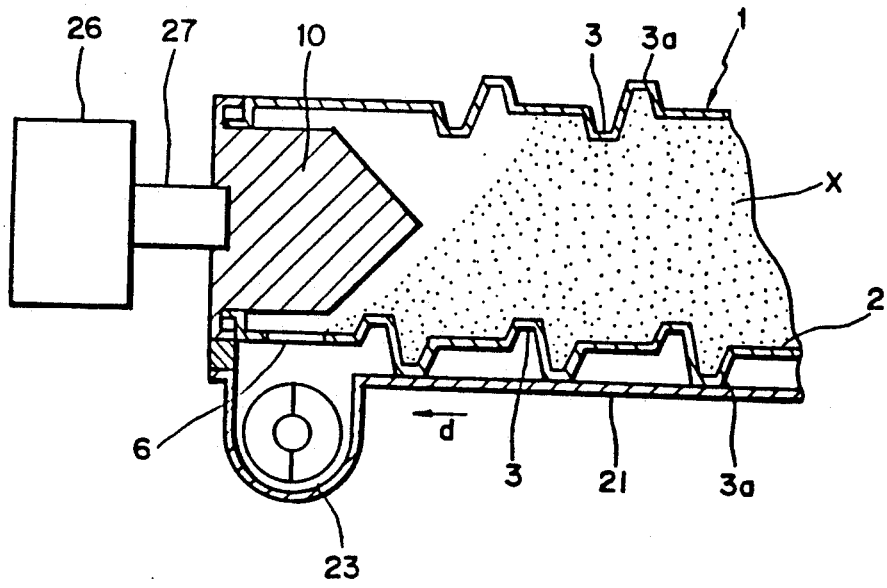

A further modification of the first embodiment of the present invention is described below referring to FIG. 13. The frame 21 of the toner transporting device 20 is extended in the axial direction of the container 1 and the cylindrical member 2 is provided with a projection 3a, which projects outwardly, parallel with the spiral projection 3. The toner (X) spilt on the frame 21 is transported toward the toner transporting pipe 24 by the projection 3a with the rotation of the container 1. Thus, the projection 3a prevents the toner (X) from scattering in the frame 21, the toner (X) is not wasted and can be efficiently used.

Figure 14:
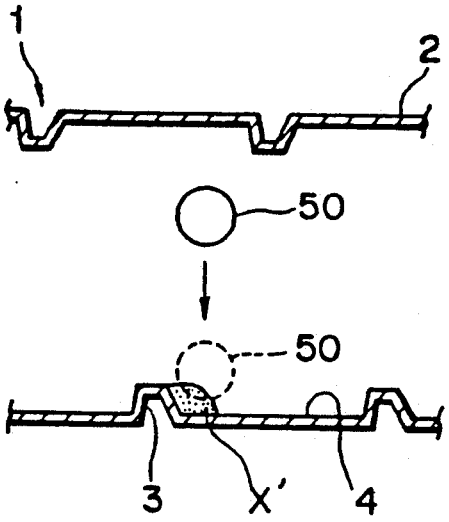
FIGS. 14 and 15 are partial longitudinal sectional views showing developer supplying containers, according to other modifications of the first embodiment of the present invention, accommodating balls.

FIG. 14 shows a still further modification of the first embodiment of the present invention, and a steel ball 50, the diameter of which is larger than the size of the opening 6 is accommodated in the container 1. The steel ball 50 is moved upward with the rotation of the container 1 with the projection 3 and then falls, thus smashing a toner mass (X') formed on the sidewall of the projection 3. Therefore, the toner (X) can be effectively used and the groove 4 is capable of appropriately transporting the toner (X).

Figure 15:
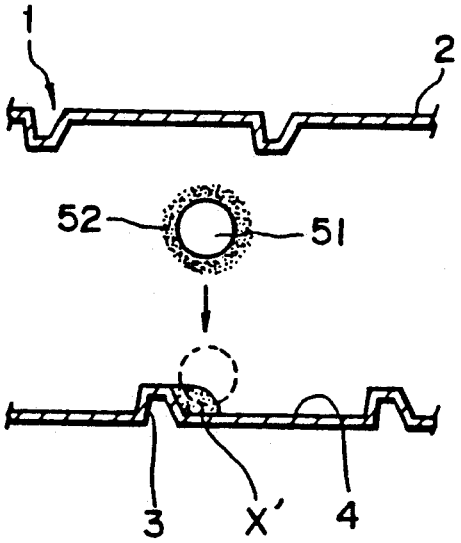

According to other modification of the first embodiment of the present invention, as shown in FIG. 15, the steel ball 51 is made of a magnetic material and magnetic powders 52 are attracted to the steel ball 51 by the magnetic force thereof. Energy generated as a result of the fall of the steel ball 51 in the cylindrical member 2 with the rotation of the container 1 is absorbed by the magnetic powders 52. Therefore, a sound generated by the collision between the cylindrical member 2 and the steel ball 51 can be reduced.

In the above-described first embodiment, the cover 10 is conical to reduce the developer transporting space toward the opening 6 in the cylindrical member 2. But a similar effect can also be obtained by the cylindrical member 2 so formed that the sectional area in the vicinity of the opening 6 of the cylindrical member 2 is gradually reduced.

Figure 16:
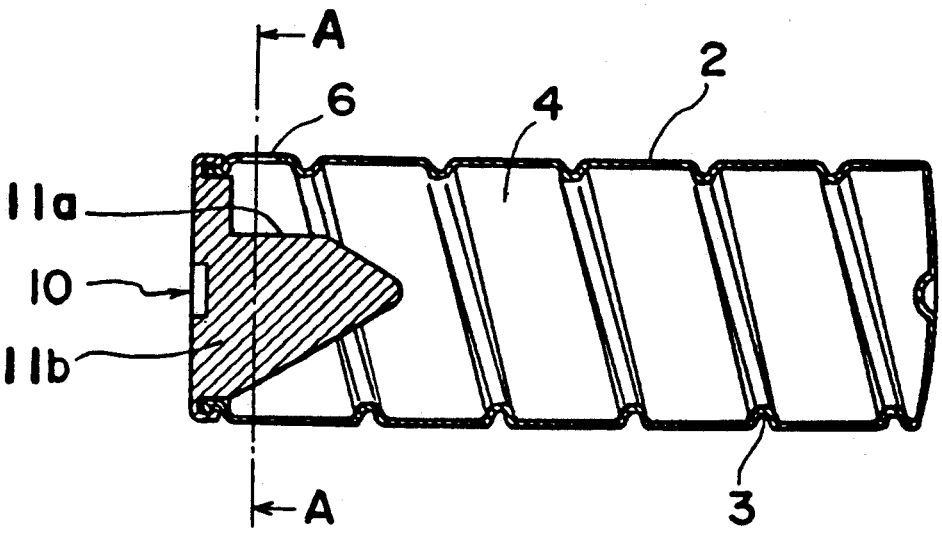
FIG. 16 is a longitudinal sectional view showing a modification of the cover of a developer supplying container.
Figure 17:
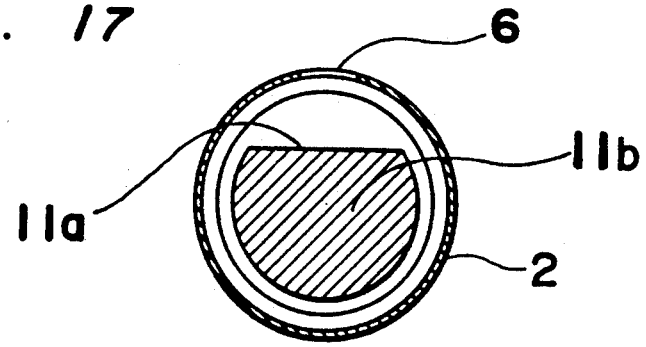
FIG. 17 is a cross sectional view taken in the line A—A of FIG. 16.
Figure 18:
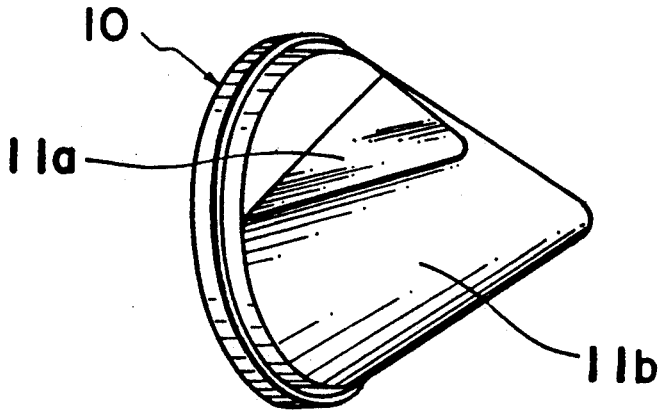
FIG. 18 is a perspective view showing the modification in FIG. 16.
Figure 19:
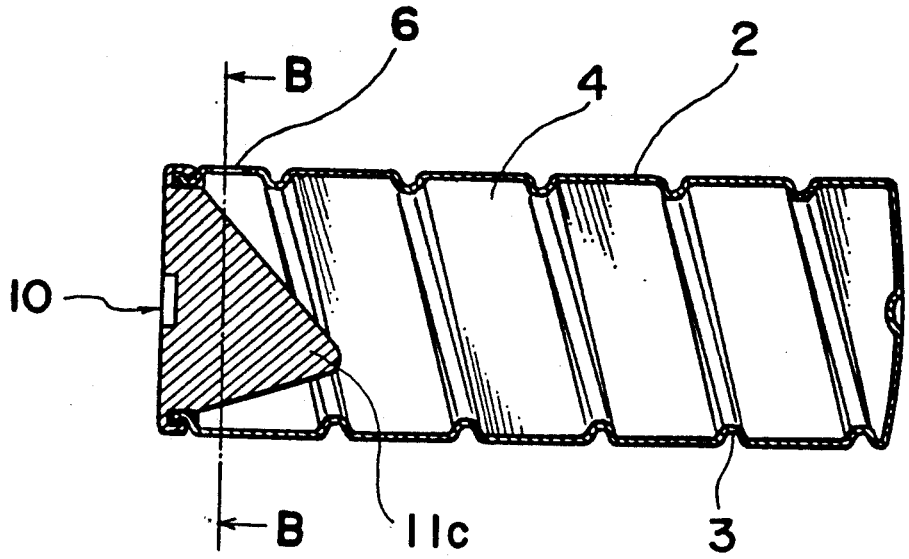
FIG. 19 is a longitudinal sectional view showing another modification of the cover of a developer supplying container.
Figure 20:
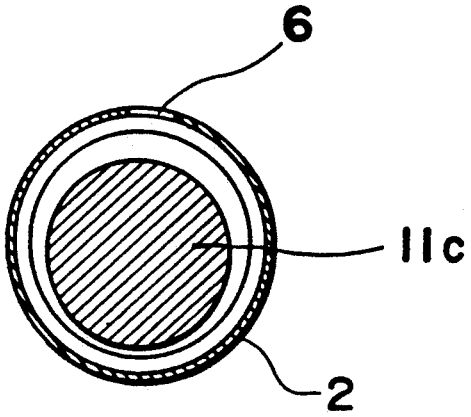
FIG. 20 is a cross sectional view taken in the line B—B of FIG. 19.

FIGS. 16–18 and 19–20 show other modifications of the first embodiment of the present invention, respectively. The cover 10 may be modified by cutting off an upper part of the conic section 11b as shown in FIG. 4 so as to form a plane 11a as shown in FIGS. 16–18. The cover 10 may also be formed as an eccentric conic section 11c as shown in FIGS. 19 and 20. As shown in FIGS. 16–20, the greater the volume is in the vicinity of the opening 6, the more toners can be dropped from the opening 6 of the container 1. Thus, toners can be stably supplied to the toner transporting device.

It is possible for the rectangular opening 6 of the embodiment to cause toners to adhere to the corners thereof when they drop therefrom and remain adhered thereto. In addition, it may be possibly difficult to process a material into a desired rectangular configuration.

Preferably, the opening 6 is circular to remedy the above-described troubles. Thus, an opening forming work is facilitated and the amount of toner which drops from the container 1 is almost constant per rotation of the cylindrical member 2.

Figure 21:
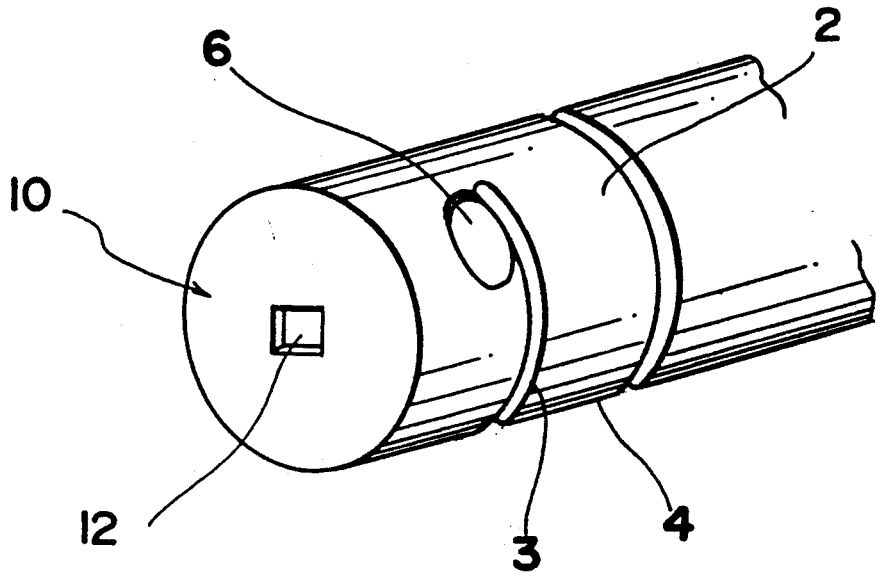
FIG. 21 is a perspective view showing a modification of the opening of a developer supplying container.

Compared with the opening 6 provided in the vicinity of the spiral groove 4 as shown in FIG. 7, the opening 6 provided alongside of the termination portion of the spiral groove 4 as shown in FIG. 21 allows toners to drop therefrom more easily. Thus, the amount of toner which finally remains accommodated in the container without dropping can be reduced.

For the increase of the amount of the dropping toner, it is possible to make the size of the opening 6 large. However, if the area of the opening 6 is too great, it is impossible to regulate the amount of toner which falls from the opening 6 and in addition, toners may drop in a great amount from the opening 6 immediately after the container 1 is mounted on the toner transporting device. Thus, the area of the opening 6 has its limit in order to stabilize the drop of toner and if the area of the opening 6 is too great, the above-described troubles occur.

Figure 22:
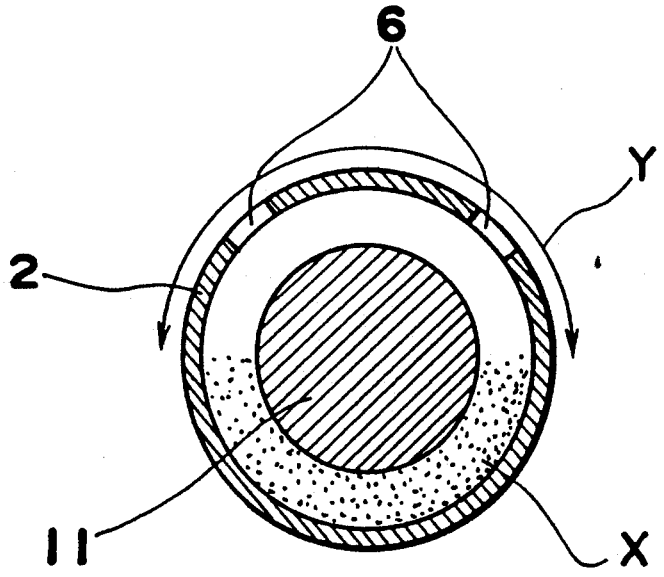
FIG. 22 is a cross sectional view showing another modification of the opening of a developer supplying container.

The amount of toner can be regulated and increased by forming a plurality of openings 6 on the peripheral surface of the cylindrical member 2 as shown in FIG. 22, while the above-described troubles can be remedied.

Toners can be prevented from dropping to the vicinity of the container 1 by forming the plurality of openings 6 on the peripheral surface thereof in the range Y within 180° with respect to the toner supplying opening 22. Thus, toners can be prevented from being spilt in the vicinity of the container 1 when it does not rotate.

As apparent from the foregoing description, according to the developer supplying device of the first embodiment, a developer accommodated in the developer supplying container is transported to the opening thereof along the spiral groove with the rotation of the cylindrical member and the amount of the developer is regulated by the developer regulating means such as the regulating section 11. Therefore, the amount of the developer positioned in the vicinity of the opening is constant. Thus, the amount of the developer supplied from the opening to the toner transporting device is almost constant per rotation of the cylindrical member.

That is, the amount of the developer supplied from the opening to the toner transporting device is proportional to the number of rotations of the developer supplying container. Therefore, the supply amount of the developer can be appropriately regulated by controlling the number of rotations of the developer supplying container. In addition, the supply amount of the developer can be varied by changing the size of the opening, the volume of the toner amount regulating space, and the rotational speed of the developer supplying container. Thus, the amount of the developer can be accurately controlled.

Figure 23:
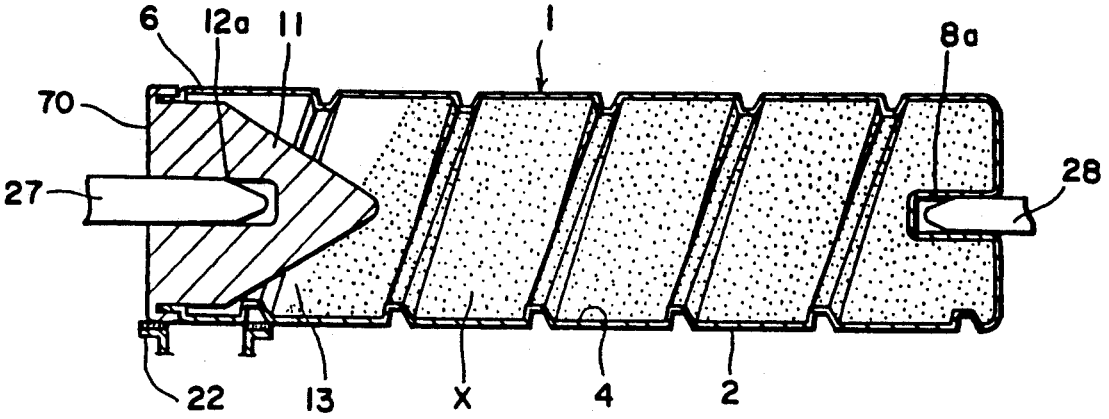
FIGS. 23 through 25 are a longitudinal sectional view, partial sectional views showing a developer supplying container according to a modification of the first embodiment of the present invention.

Referring to FIG. 23, compared with the cover 10 shown in FIG. 1, the engaging concave 12a of a cover 70 and the concave 8a formed in the rear wall 7 of the cylindrical member 2 are deep. The driving shafts 27 and 28 are inserted into the concave 12a and the concave 8a, respectively. Since the concaves 12a and 8a are deep, the cylindrical member 2 can be reliably supported, so that the rotation of the cylindrical member 2 is ensured.

Figure 24:
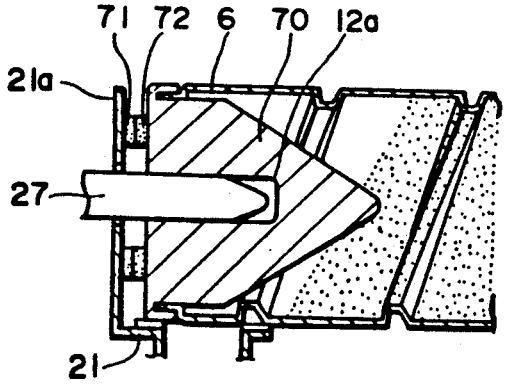

Referring to FIG. 24, ring members 71 and 72 made of urethane foam or the like in the same configuration are provided between the cover 70 and a wall 21a, which confronts the cover 70, formed on the frame 21 so that the ring members 71 and 72 are positioned in the periphery of the driving shaft 27. The ring members 71 and 72 slide in contact with each other when the cylindrical member 2 rotates. The ring members 71 and 72 prevent toners spilt from the cylindrical member 2 from adhering to the driving shaft 27 or entering the concave 12. Thus, the driving system of the cylindrical member 2 can be prevented from being soiled by toners. A load applied to the driving system of the cylindrical member 2 can be reduced by a low frictional properties member of polytetrafluoroethylene or the like fixed to the faces of the ring members 71 and 72 which slidably contact with each other.

Figure 25:
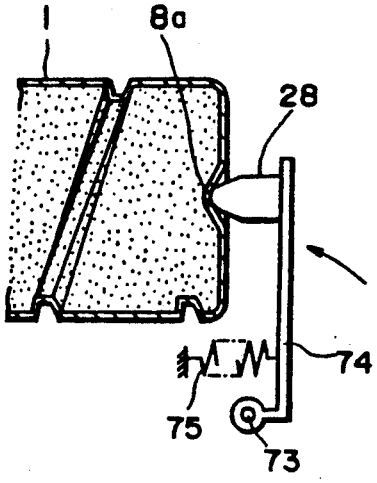

FIG. 25 shows a construction of the shaft 28 for supporting one end of the cylindrical member 2. The shaft 28 is fixed to an arm 74 rotatably mounted on a supporting shaft 73. The arm 74 is urged by a spring 75 in the direction shown by the arrow. Accordingly, the shaft 28 is pressed against the concave 8*a* of the cylindrical member 2. The arm 74 is pivoted in the direction opposite to the direction shown by the arrow when the cylindrical member 2 is removed from the shaft 28.

Figure 26:
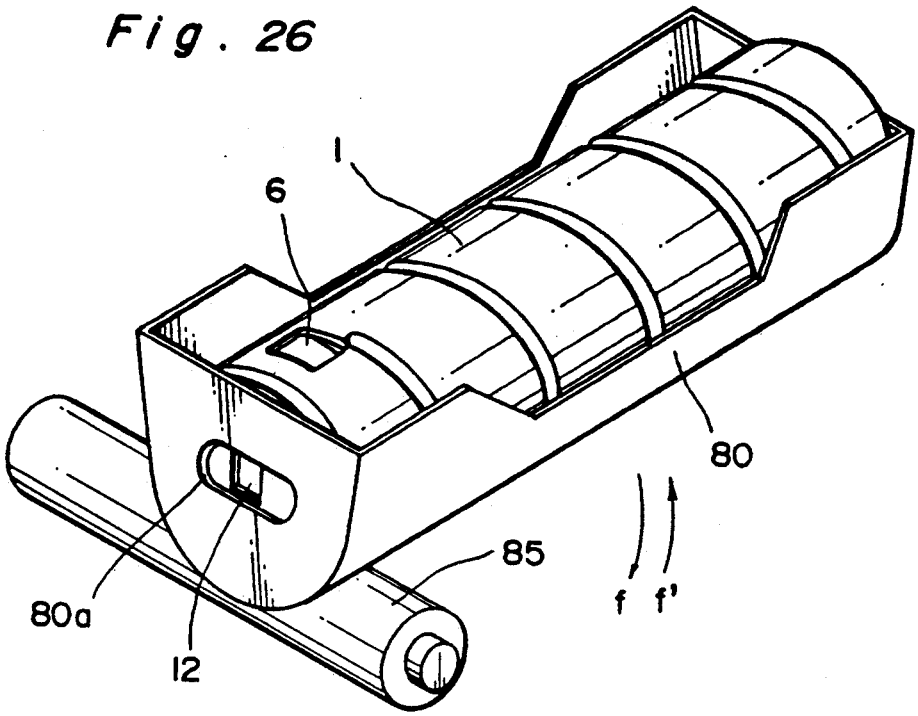
FIGS. 26 through 28 are a perspective view, a cross sectional view, and a longitudinal sectional view showing a container for accommodating the cylindrical member according to a second embodiment of the present invention.
Figure 28:
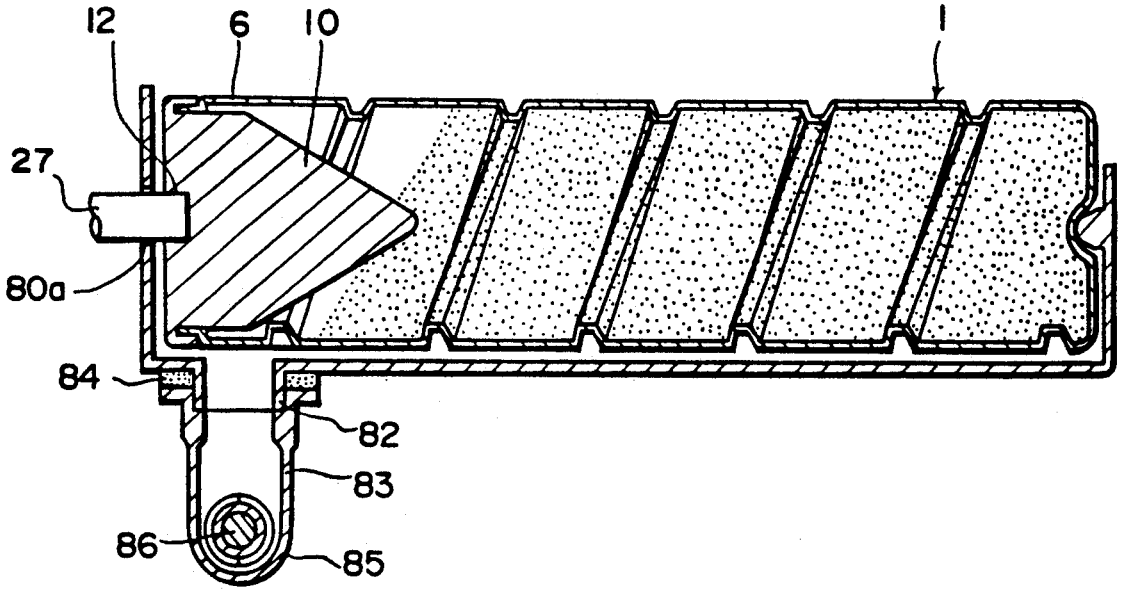
Figure 27:
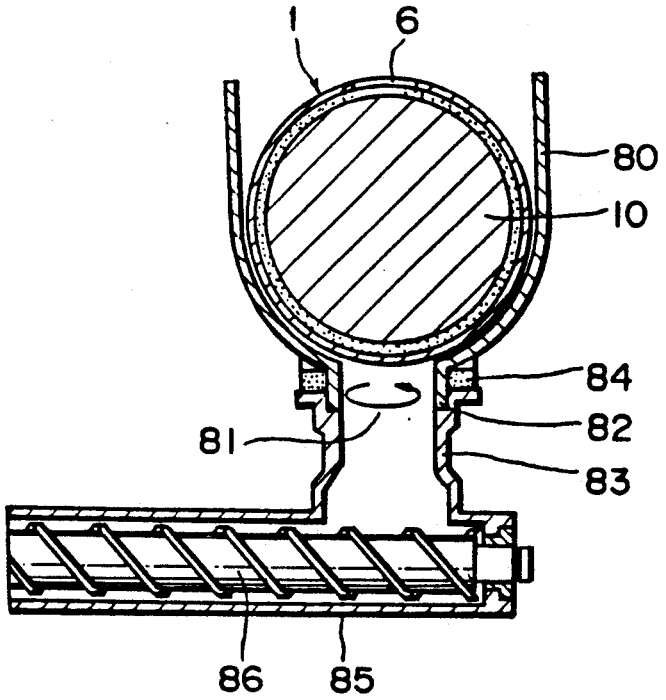

The second embodiment of the present invention is described below with reference to FIGS. 26, 27, and 28.

In a toner transporting device according to the second embodiment, the configuration of the bottom of a container 80 for accommodating the cylindrical member 2 corresponds to the peripheral configuration of the cylindrical member 2. An opening 81 is connected to a toner supplying pipe 82. A connecting pipe 83 extends from a toner transporting pipe 85 accommodating a toner transporting blade 86. The toner supplying pipe 82 is connected with the connecting pipe 85. The contact face between the toner supplying pipe 82 and the connecting pipe 83 is sealed with a ring-shaped sealing member 84.

Accordingly, in the toner transporting device, the container 80 is capable of rotating in directions (f) and (f') through the portion in which the toner supplying pipe 82 and the connecting pipe 83 are connected with each other. Therefore, the container 80 can be moved outside an image forming apparatus and the developer supplying container 1 can be mounted on or removed from the image forming apparatus without interfering other members thereof. In addition, at the moment, toners which have spilt from the container 1 to the container 80 do not fall in the periphery thereof. In addition, the sidewall of the container 80 is high enough to prevent toners, which have spilt from the container 1 to the container 80, from flying over the sidewall even though toners are transported by the rotation of the container 1 in the peripheral direction of the container 80. The developer supplying container 1 can be replaced without removing the container 80 from the developer transporting device because the container 80 is made of elastic material such as plastic and the container 1 can be removed from the container 80 by making the use of the elastic properties of the container 80. Since the opening 80*a* formed at one end of the container 80 is extended transversely into which the shaft 27 is inserted, the shaft 27 can not prevent the horizontal rotation of the container 80 for replacing it.

Figure 29:
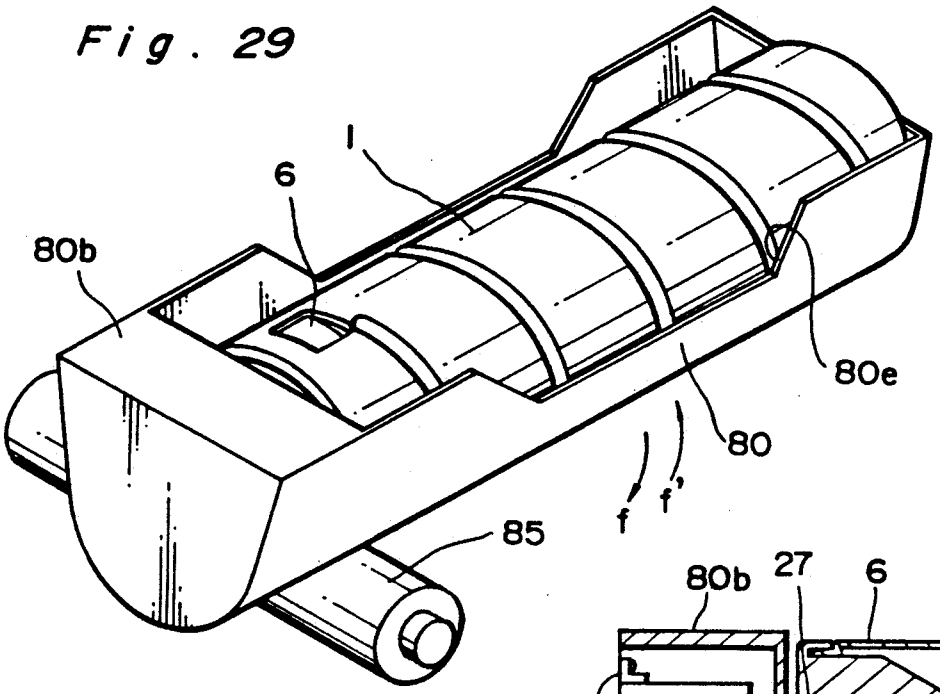
FIGS. 29 and 30 are a perspective view and a longitudinal sectional view showing a container according to a modification of the second embodiment of the present invention.
Figure 30:
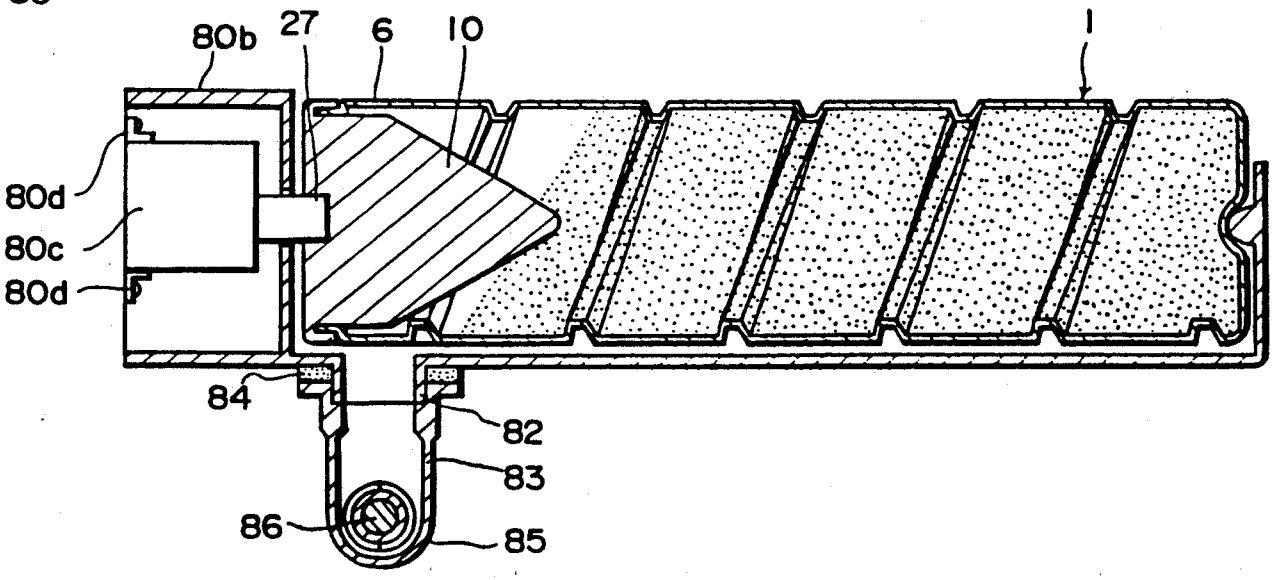

Furthermore, as shown in FIGS. 29 and 30, the container 80 can comprise a motor cover 80*b* adjacent to one end of the container 80 in which a motor 80*c* is accommodated and fixed by a motor fixing-member 80*d*, so that the shaft 27 of the motor 80*c* can not prevent the rotation of the container 80 for replacing it. The replacing operation of the container 80 can be performed smoothly in a case where the container 80 has a cutout 80*e* at each side surface thereof as shown in FIG. 29 and the concave 8 is shallow so as to easily remove the shaft 28 from the concave 8.

The developer falling opening 6 may be formed on the cover 10 instead of forming it on the peripheral surface of the cylindrical member 2 of the container 1.

In the above-described second embodiment, the driving shaft 27 is fitted into the concave 12*a* (12) of the cover 70 (10) and the shaft 28 is fitted into the concave 8*a* (8) of the cylindrical member 2. Thus, the shafts 27 and 28 are supported by the concaves 12*a* (12) and 8*a* (8). But the cylindrical member 2 may be supported by transmitting a rotational force to a shaft provided at the cover 70 (10) and a shaft provided at the rear end of the cylindrical member 2 or by each shaft provided at a cover mounted on the opening formed on each open end of the cylindrical member 2.

Figure 31A:
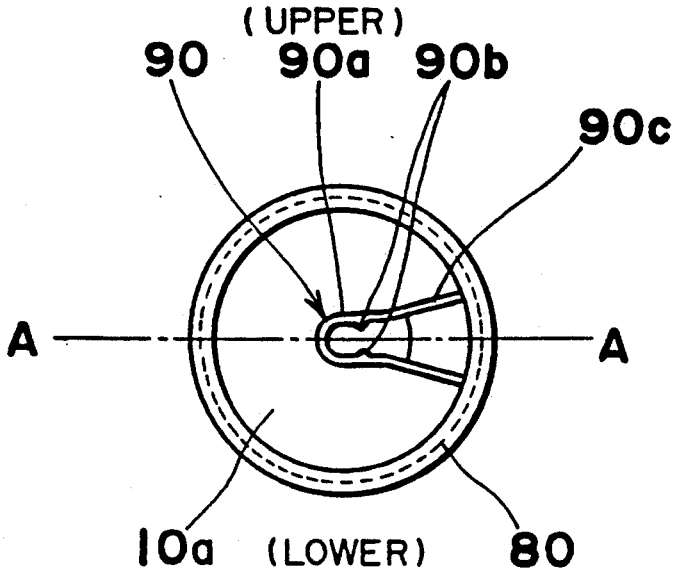
FIG. 31(*a*) is a side view showing a cylindrical member according to a third embodiment of the present invention.
Figure 31B:
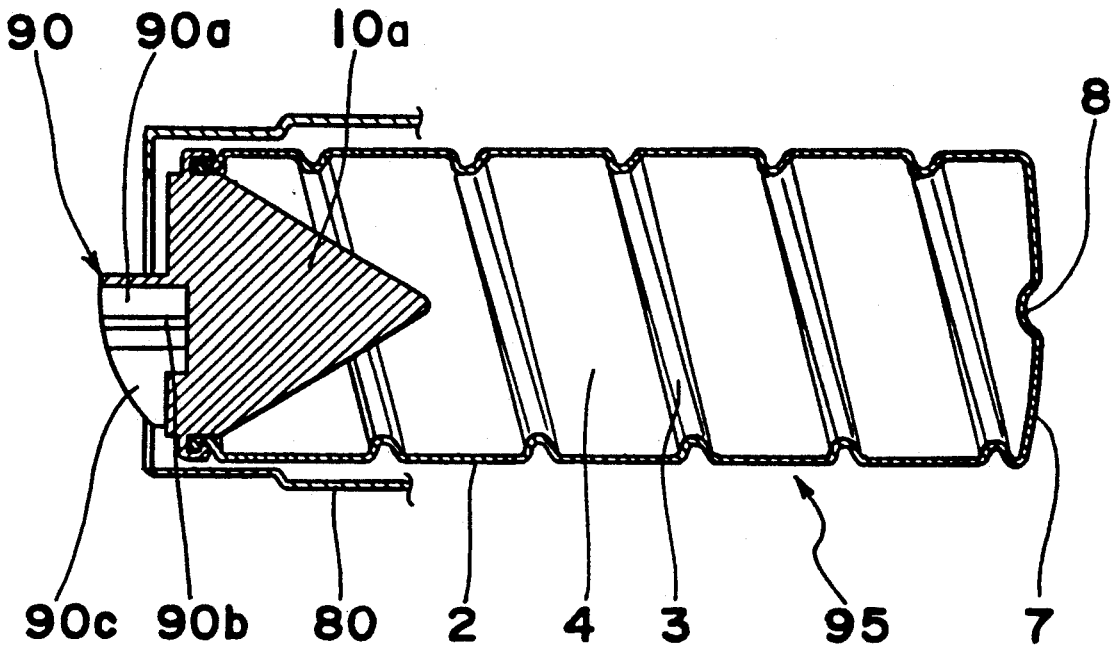

It is possible to removably mount the container 1 with the opening 6 of the cylindrical member 2 aligning with the toner receiving opening. FIG. 31 shows the cylindrical member 2 according to the third embodiment of the present invention. FIG. 31(*a*) is a side view showing a cover 10*a* of the cylindrical member 2. A rib 90 mounted on the outer surface of the cover 10*a* receives a rotary shaft 91*a* of a driving device 92. The rib 90 comprises a shaft receiving section 90*a*, a shaft guiding section 90*b*, and a drive force transmitting section 90*c*. The shaft receiving section 90*a* positioned in the center of the cover 10*a* is cylindrical and partly cut away to receive the shaft 91*a* of the driving device 92. The shaft guiding section 90*b* guides the shaft 91*a* and normally prevents the shaft 91*a* engaged by the shaft receiving section 90*a* from disengaging therefrom. The angle formed by the ribs of the drive force transmitting section 90*c* with respect to the line A—A in FIG. 31(*a*) is wider than the angle formed by the ribs of the shaft guiding section 90*b*. FIG. 31(*b*) is a sectional view of the developer supplying container 95 taken along the line A—A in FIG. 31(*a*), namely, a plan view of the cylindrical member 2.

Figure 32:
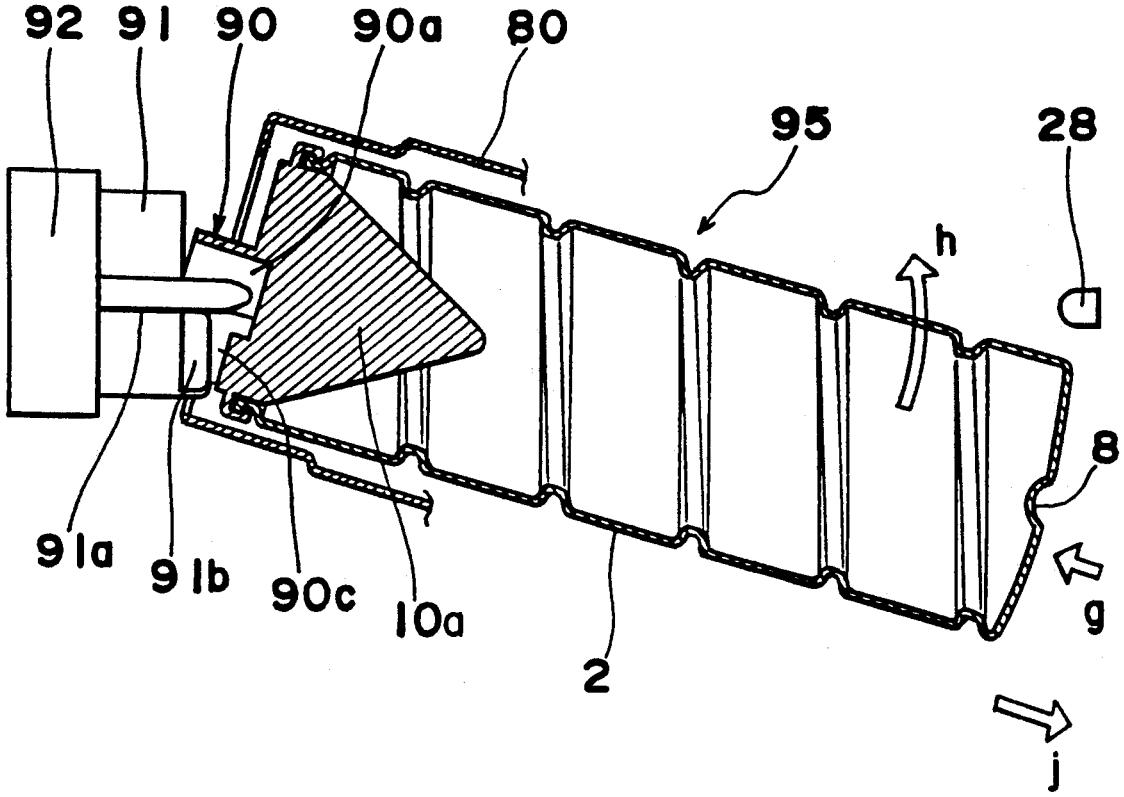
FIG. 32 is a sectional view showing the cylindrical member shown in FIG. 31 into which the shaft of the driving device is inserted.
Figure 33:
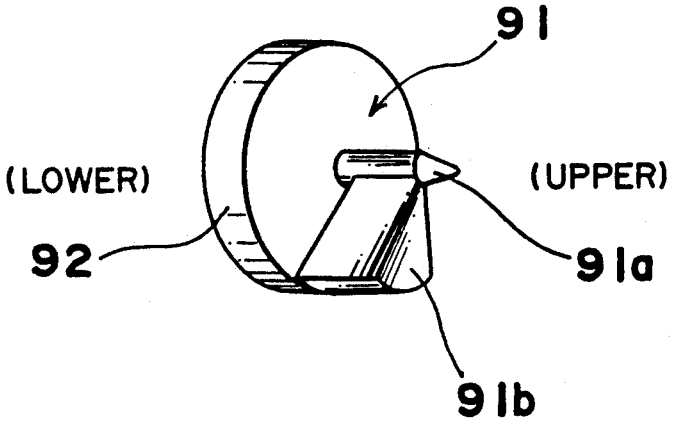
FIG. 33 is a perspective view showing a drive force transmitting member of the driving device of FIG. 32.

FIG. 32 is a sectional view showing the cylindrical member 2 into which the shaft 91*a* of the driving device 92 is inserted. The insertion of the cylindrical member 2 into the container 80 in the direction shown by the arrow (g) is completed when the cylindrical member 2 is brought in contact with a drive force transmitting member 91 of the driving device 92. The drive force transmitting member 91 comprises the shaft 91*a* and a drive force transmitting section 91*b*. The drive force transmitting section 91*b* is so formed, as shown in FIG. 33, that it is fitted into the drive force transmitting section 90*c* of the rib 90.

When the cylindrical member 2 is rotated in the direction shown by the arrow (h) about the toner receiving opening, the shaft 91*a* is inserted into the shaft receiving section 90*a* of the rib 90 and the shaft 28 is fitted into the concave 8 formed in the rear end of the cylindrical member 2.

Thus, the driving device 92 transmits the driving force to the cylindrical member 2 through the shaft 91*a*, thus rotating the cylindrical member 2. Consequently, the developer is supplied therefrom to the toner transporting device.

The cylindrical member 2 can be replaced without spacing the opening 6 of the cylindrical member 2 from the toner supplying opening of the toner transporting device by rotating the cylindrical member 2 in the direction opposite to the direction shown by the arrow (h).

As apparent from the above, the cylindrical member of the developer supplying container is rotated about the supporting means, the shafts, arranged on each end thereof.

Therefore, since the rotational axis of the cylindrical member is not displaced, a load applied to the driving system of the cylindrical member is stably. Further, since the developer supplying opening of the cylindrical member is not displaced, the developer dropping opening, or the developer dropping path is not displaced from the developer receiving opening of the developer transporting device. Therefore, the developer is not spilt from the developer dropping opening, thus not soiling the periphery of the developer supplying device.

Figure 34:
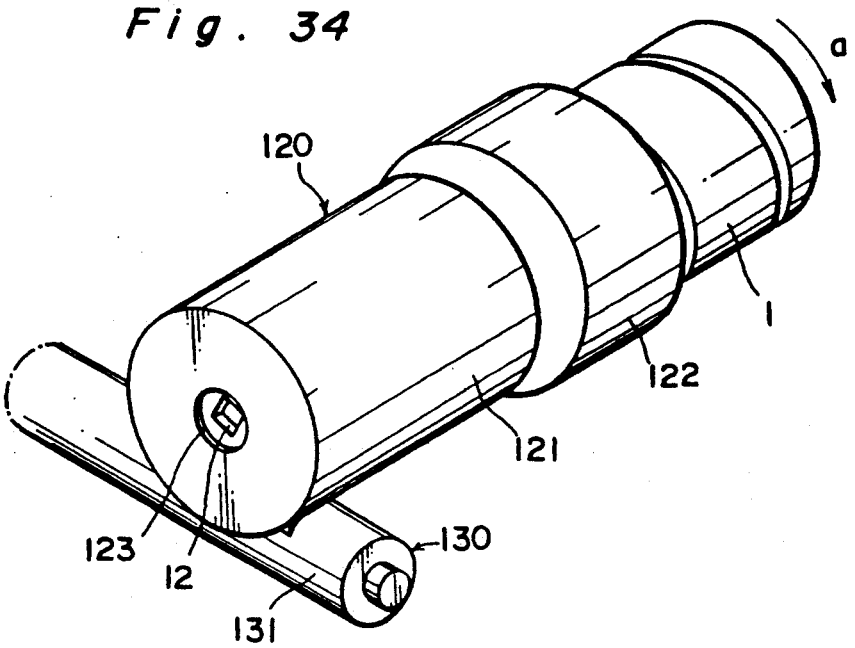
FIG. 34 is a perspective view showing a developer supplying device according to the fourth embodiment of the present invention.
Figure 35:
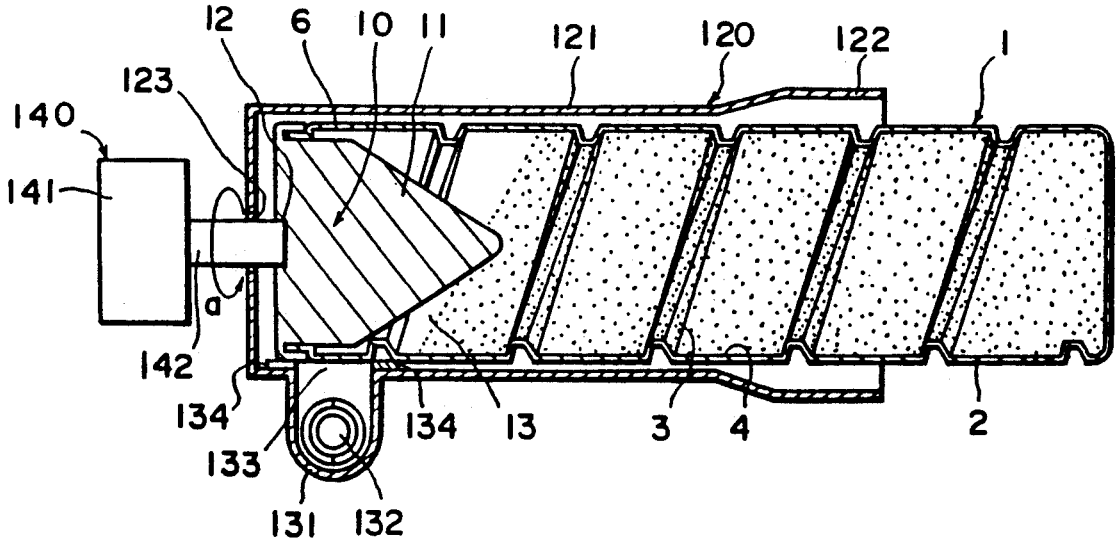
FIG. 35 is a longitudinal sectional view showing the developer supplying device of FIG. 34.

Referring to FIGS. 34 and 35, the container 1 according to a fourth embodiment of the present invention comprises a holding section 120, a transporting section 130, and a driving section 140.

The holding section 120 has a cylinder 121, one end of which opens to the outside. The inner diameter of the cylinder 121 is a little greater than the outer diameter of the cylindrical member 2. A guiding section 122 of which the inner diameter is larger than that of the cylinder 121 is formed on one end, which is open to the outside, of the cylinder 121. An opening 123 is formed in the center of the other end, which is closed, of the cylinder 121. The holding section 120 is substantially horizontally held by the transporting section 130.

The transporting section 130 comprises a transporting blade 132 mounted in a transporting path 131 connected to a developing section (not shown). The transporting blade 132 is rotated by a motor not shown. A toner supplying opening 133 is formed at a portion for connecting the transporting section 130 and the holding section 120 with each other. The cylinder 121 has sealing members 134 and 134 formed at the inner peripheral surface, on the both longitudinal sides (the right and left sides in FIG. 35) of the toner supplying opening 133, of the cylinder 121.

The driving section 140 comprises a driving device 41, a driving shaft 142 of which is inserted into the opening 123 of the cylinder 121.

Referring to FIGS. 34 and 35, the sealing tape attached to the opening 6 is removed therefrom and the container 1 is introduced into the cylinder 121 with the opening 6 upward while one end, which has the cover 10, of the container 1 firstly is inserted into the cylinder 121. Then, the shaft 142 is fitted into the concave 12. Thus, the container 1 is supported by the shaft 142 and the cylinder 121.

The container 1 supported by the holding section 130 is rotated in the direction shown by the arrow (a) by the shaft 142 driven by the driving device 141.

The toner (X) accommodated in the container 1 is transported toward one end, which has the cover 10, of the cylindrical member 2 along the groove 4 with the rotation of the container 1 in the direction shown by the arrow (a). The manner in which the amount of the toner supplied from the opening 6 is regulated by the cover 10 is the same as that described in the first embodiment.

Figure 36:
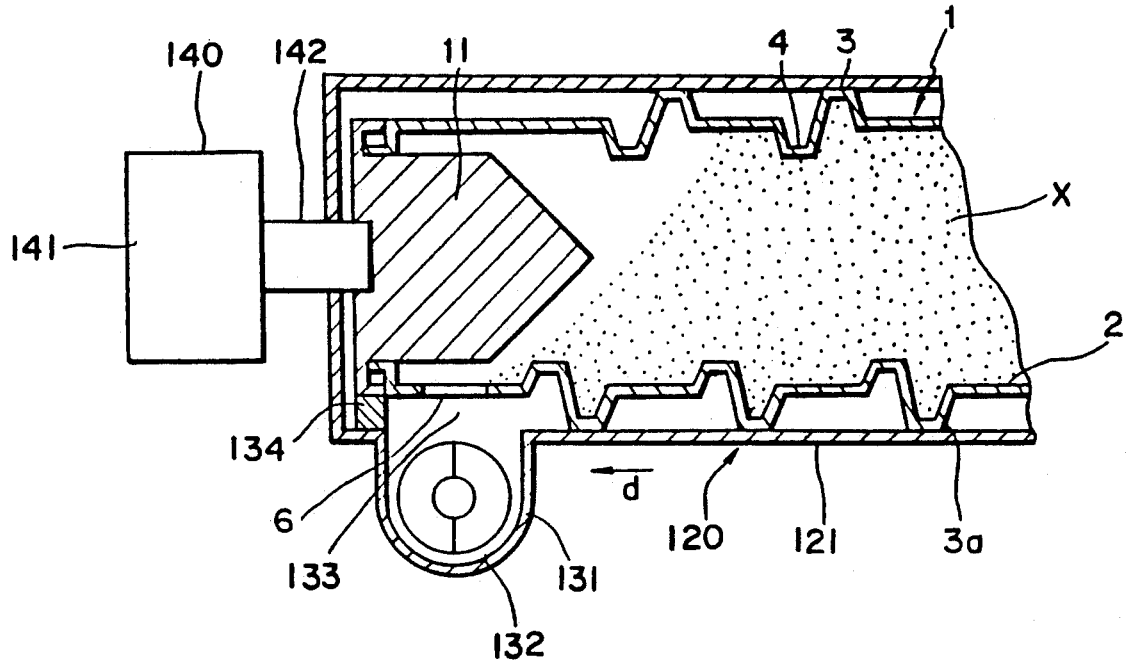
FIG. 36 is a partial longitudinal sectional view showing a developer supplying device according to a modification of the fourth embodiment of the present invention.

A modification of the fourth embodiment of the present invention is described below referring to FIG. 36. The holding section 120 is extended in the axial direction of the container 1 and the cylindrical member 2 is provided with a projection 3*a*, which projects outwardly, parallel with the spiral projection 3. The toner (X) spilt on the cylinder 121 is transported toward the toner transporting path 131 by the projection 3*a* with the rotation of the container 1. Thus, the projection 3*a* prevents the toner (X) from scattering in the cylinder 121, the toner (X) is not wasted and can be efficiently used.

Figure 37:
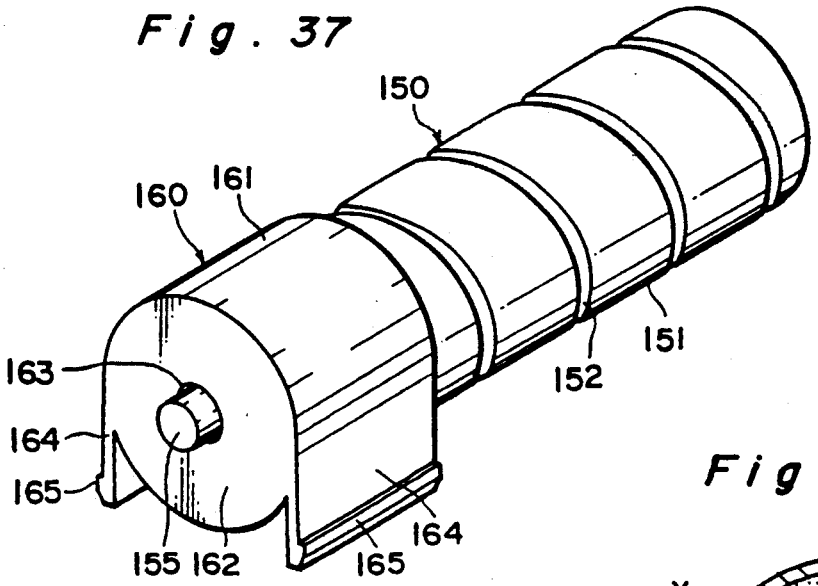
FIGS. 37-39 are a perspective view and sectional views showing a developer supplying device according to another modification of the fourth embodiment of the present invention.
Figure 38:
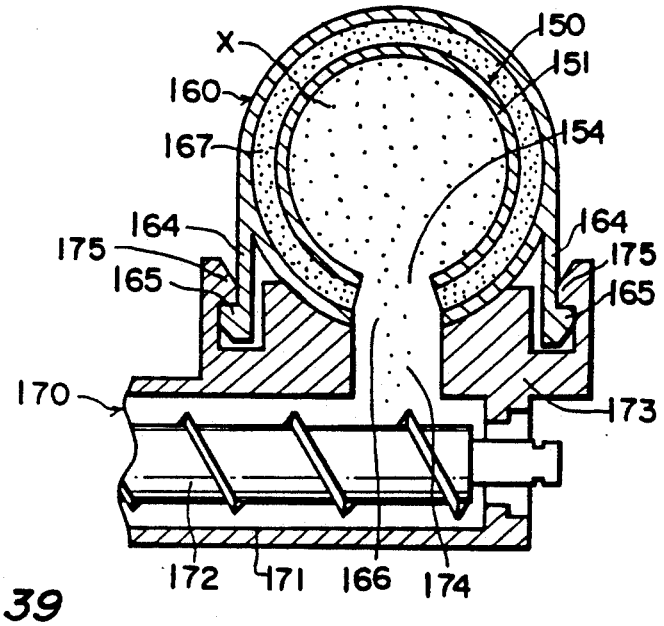
Figure 39:
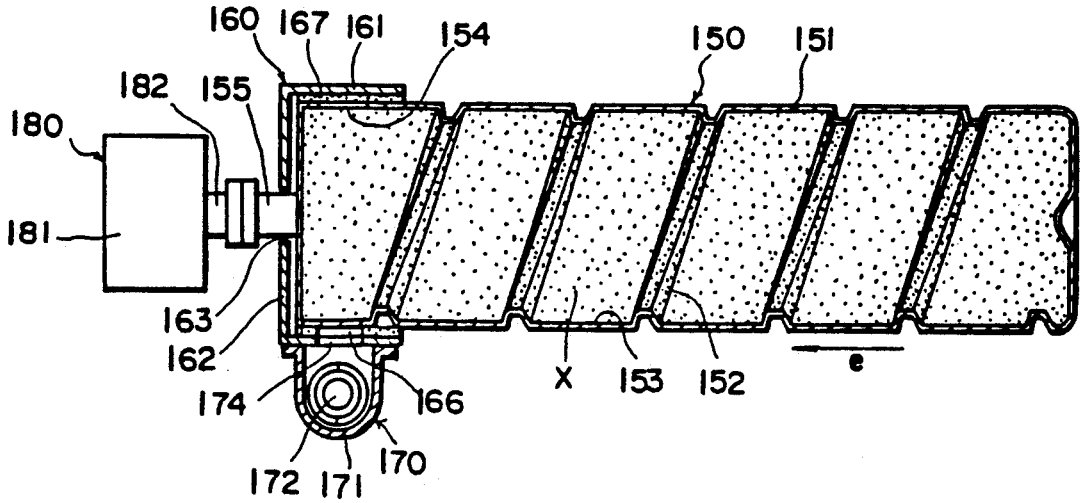

Referring to FIGS. 37, 38, and 39, another modification of the fourth embodiment of the present invention is described below, of which a container 150 comprises a holding section 160, a transporting section 170, and a driving section 180.

Similarly to the container 1, the container 150 comprises a projection 152 spirally formed along the peripheral surface of a cylindrical member 151, a spiral groove 153 formed between projections 152 and 152, and an opening 154 formed in the vicinity of one end thereof. Different from the container 1 described above, the container 150 has no conical regulating section. A drive force connecting section 155 for connecting the container 150 to a driving device 181, which is described later, is formed in the center of the end face of the container 150 to project therefrom.

In the holding section 160, one end of a cylinder 161 is closed with a wall 162 and the opening 163 is formed in the center of the wall 162. A pair of legs 164 and 164 are formed on the peripheral surface of the cylinder 161 and a projection 165 is formed on the outer surface of the end of each leg 164. In the cylinder 161, an opening 166, or toner dropping path is formed between the legs 164 and 164 and a sealing member 167 made of urethane or felt or the like is mounted in the inner peripheral surface of the cylinder 161. The provision of a sheet made of polytetrafluoroethylene, which has low frictional properties, on the surface of the sealing member 167 reduces the frictional force between the sealing member 167 and the container 150.

The toner transporting section 170 comprises a transporting path 171 accommodating a transporting blade 172 rotatably mounted therein. A supporting section 173 is mounted above one end of the toner transporting section 170. A toner dropping opening 174 communicating with the transporting path 171 is formed through the supporting section 173. An engaging portion 175 is formed on each side of the supporting section 173, respectively.

The driving section 180 includes the driving device 181 having a driving shaft 182 capable of connecting with the drive force connecting section 155.

In the above construction, the container 150 is inserted into the cylinder 161 with one end comprising the drive force connecting section 155 and the opening section 154 forward, so that the drive force connecting section 155 projects from the opening 163.

As shown in FIGS. 37 and 38, each of the projections 165 engages the corresponding engaging portion 175 of the supporting section 173. Thus, the holding section 160 holding the container 150 is fixed to the supporting section 173. Consequently, the opening 166 of the holding section 160 aligns with the opening 174 of the toner transporting section 170, i.e., both communicate with each other and the drive force connecting section 155 is connected with the shaft 182 of the driving device 181.

When the driving device 181 is driven, the rotation of the shaft 182 is transmitted to the container 150 through the drive force connecting section 155 and the container 150 rotates in the holding section 160. With the rotation of the container 150, toners accommodated therein are transported in the direction shown by the arrow (e)

along the spiral groove 153 in FIG. 39. When the opening 154 communicates with the opening 166, toners drop into the toner transporting path 171 to be supplied thereto. As described previously, the sealing member 167 mounted on the inner peripheral surface of the cylinder 161 covers the opening 154 of the container 150. Therefore, toners are prevented from being fed out of the container 150 unless the opening 154 aligns with the opening 166. The leakage of toners from the opening 154 can be efficiently prevented by that the opening 154 is covered with a cover which can be opened and that toners drop from the opening 154 only when the opening 154 confronts the opening 166.

According to this device, the container 150 is removed from the toner transporting section 170 together with the holding section 160 and the opening 166 is completely sealed with the sealing member 167. Accordingly, the leakage of toners from the container 150 can be prevented when it is mounted in or removed from the cylinder 161.

Figure 40:
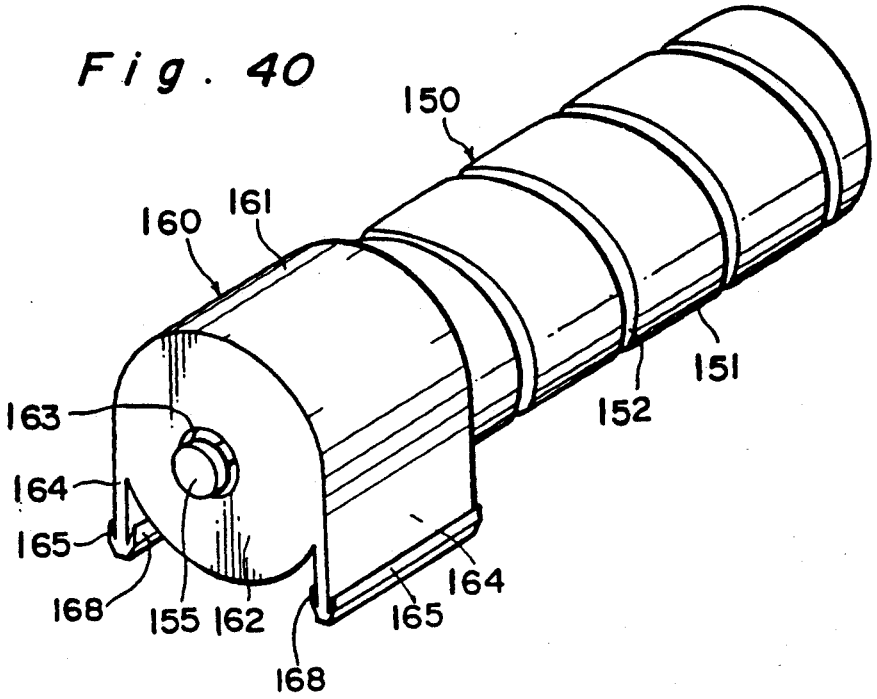
FIGS. 40 and 41 are a perspective view and a cross sectional view showing a developer supplying device according to a still an modification of the fourth embodiment of the present invention.
Figure 41:
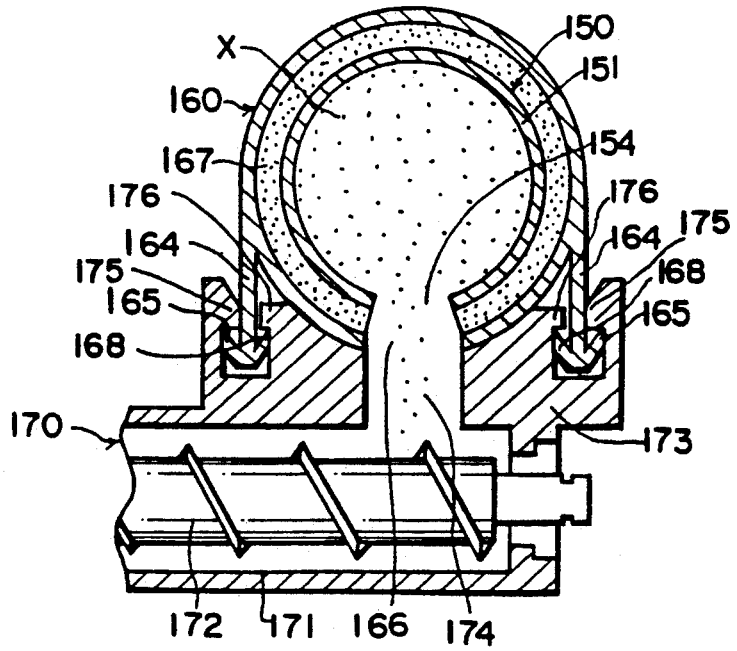

As shown in FIGS. 40 and 41, the container 150 can be firmly mounted on the holding section 160. That is, in addition to the projections 165 and 165, projections 168 and 168 are formed on the inner surface of the legs 164 and 164 at each lower end thereof, and the projections 168 and 168 respectively engage engaging portions 176 and 176 formed on the supporting section 173.

When toners accommodated in the container 150 are consumed, the container 150 secured to the holding section 160 is removed from the toner transporting section 170 and a new container 150 is mounted in the cylinder 161.

According to this device, once the cylinder 161 is mounted to the toner transporting section 170, the cylinder is fixed thereto and cannot be removed therefrom.

As apparent from the foregoing description, according to the developer supplying device of the fourth embodiment, the developer supplying container can be inserted into the holding section from one end thereof. Therefore, the operation for mounting it in the holding section can be facilitated. In addition, since the construction of the holding section is simple, the number of parts used is small, hence the developer supplying device can be easily assembled. Further, the holding section can prevent toners from spilling from the toner supplying container.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at the peripheral surface of said container to supply the developer therethrough; and regulating means provided in said container and regulating an amount of the developer supplied from said supplying means, said regulating means being so formed to reduce a sectional area between said regulating means and an inner surface of said container in the vicinity of said supplying means.

2. A developer supplying device as claimed in claim 1, wherein said regulating means has a substantially cone shape of which a section in the vicinity of said supplying means is partially cut to partially increase the sectional area in the vicinity of said supplying means.

3. A developer supplying device as claimed in claim 1, wherein said supplying means is located at an end of the spiral groove to be elongated along the spiral groove.

4. A developer supplying device as claimed in claim 1, wherein said supplying means further has another opening provided at the peripheral surface of said container to supply the developer therethrough, another opening being away from the opening within 180°.

5. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at the peripheral surface of said container to supply the developer therethrough;

regulating means provided in said container and regulating an amount of the developer supplied from said supplying means, said regulating means being so formed to reduce a sectional area between said regulating means and an inner surface of said container in the vicinity of said supplying means;

supporting means for supporting said container and having a developer receiving means for receiving the developer supplied by said supplying means; and cover means provided at the peripheral surface of said container for covering said supplying means, said cover means being opened to uncover said supplying means when the latter confronts said developer receiving means for supplying the developer.

6. A developer supplying device as claimed in claim 5, wherein said cover means is supported to be capable of rotating by a shaft arranged along the axial direction at one end of said container.

7. A developer supplying device as claimed in claim 5, wherein said cover means is arranged to be capable of sliding by a spring member in a rotary direction of said container.

8. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at the peripheral surface of said container to supply the developer therethrough;

regulating means provided in said container and regulating an amount of the developer supplied from said supplying means, said regulating means being so formed to reduce a sectional area between said regulating means and an inner surface of said container in the vicinity of said supplying means; and stirring means in a form of a ball included in said container and movable within said container in accordance with rotation thereof to stir the developer accommodated therein.

9. A developer supplying device as claimed in claim 8, wherein the ball of said stirring means is larger than the opening of said supplying means.

10. A developer supplying device as claimed in claim 8, wherein said stirring means is a magnetic member of which magnetic powders are attracted to a peripheral surface.

11. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at the peripheral surface of said container to supply the developer therethrough; and drive means for rotating said container, wherein said container is rotatably supported at its both ends by a first shaft and a second shaft respectively, said drive means rotating the first shaft to rotate said container, wherein a wall is arranged at one end of said container to confront said container and ring members are arranged at confronting surfaces of the wall and one end of said container around the first shaft.

12. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough; and drive means provided at a side of said supplying means for rotating said container, wherein said container is rotatably supported at its both ends by a first shaft and a second shaft respectively, said drive means rotating the first shaft to rotate said container, wherein the second shaft is urged by a spring member toward said container.

13. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough; and drive means provided at a side of said supplying means for rotating said container, wherein said container is rotatably supported at its both ends by a first shaft and a second shaft respectively, said drive means rotating the first shaft to rotate said container, wherein said container is supported by holding means having the second shaft.

14. A developer supplying device as claimed in claim 13, wherein said holding means has guide means for guiding the developer supplied by said supplying means, and is horizontally rotatable around the guide means.

15. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough;

holding means capable of being inserted thereinto said container and having developer receiving means for receiving the developer supplied through said supplying means from said container;

transporting means for transporting the developer supplied through the developer receiving means for development;

drive means provided at a side of said supplying means for rotating said container; and connecting means provided at one side of said container for directly connecting said drive means and said container and for rotation of said container within said holding means by said drive means.

16. A developer supplying device as claimed in claim 15, wherein a projection is formed at the peripheral surface of said container.

17. A developer supplying device as claimed in claim 15, wherein said holding means has an enlarged-diameter guiding section.

18. A developer supplying device as claimed in claim 15, wherein said holding means is removably attached to said device.

19. A developer supplying device as claimed in claim 15, wherein said holding means is fixed to said device after said holding means is attached thereto.

20. A developer supplying device comprising:

s developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough;

transporting means for transporting the developer supplied from said container for development;

holding means for holding said container, said holding means having guide means for guiding the developer supplied through said supplying means from said container to said transporting means, said holding means being further pivotable to enable detachment of said container therefrom;

drive means provided at a side of said supplying means for rotating said container; and a first supporting means for rotatably supporting said container thereby and for transferring rotary force from said drive means to said container therethrough.

21. A developer supplying device as claimed in claim 20, wherein second supporting means is arranged at said holding means, and said container is horizontally supported by said first supporting means and said second supporting means.

22. A developer supplying device as claimed in claim 20, wherein a seal member is arranged at a connecting portion between the guide means of said holding means and said transporting means.

23. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough;

drive means provided at a side of said supplying means for rotating said container to supply the developer from said supplying means and including a drive shaft; and driven means provided at one end of said container for connection with the drive shaft which includes a shaft receiving section and a shaft guiding section adjacent thereto, wherein said driven means on said container is connected with the drive shaft through the shaft guiding section and the shaft receiving section.

24. A developer supplying device as claimed in claim 23, further comprising holding means having guide means for guiding the developer supplied from said supplying means, said holding means being horizontally rotatable around the shaft guiding system.

25. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at an edge of a peripheral surface of said container to supply the developer therethrough; and drive means provided at a side of said supplying means for rotating said container, wherein said container is rotatably supported at its both ends by a first shaft and a second shaft respectively and at least one of the ends of said container has a concavity at the center thereof so as to engage with the second shaft, said drive means rotating the first shaft to rotate said container.

26. A developer supplying device comprising:

a developer container of substantially cylindrical form and having on its inner surface a spiral groove extending therearound in an axial direction thereof, said container being rotatable to transport a developer therein by the spiral groove;

supplying means in a form of an opening provided at the peripheral surface of said container to supply the developer therethrough;

regulating means provided in said container and regulating an amount of the developer supplied from said supplying means, said regulating means being so formed to reduce a sectional area between said regulating means and an inner surface of said container in the vicinity of said supplying means; and drive means for rotating said container, wherein said container is rotatably supported at its both ends by a first shaft and a second shaft respectively, said drive means rotating the first shaft to rotate said container.

* * * * *